US007661604B1

(12) United States Patent
MacLean-Blevins

(10) Patent No.: US 7,661,604 B1
(45) Date of Patent: Feb. 16, 2010

(54) SYSTEM AND METHOD FOR CONTROLLED DOSING AND DISPENSING OF LIQUID MATERIAL

(76) Inventor: Mark T. MacLean-Blevins, 679 Arbor Dr., Westminster, MD (US) 21158

( * ) Notice: Subject to any disclaimer, the term of this patent is extended or adjusted under 35 U.S.C. 154(b) by 257 days.

(21) Appl. No.: 11/723,047

(22) Filed: Mar. 16, 2007

Related U.S. Application Data

(60) Provisional application No. 60/782,537, filed on Mar. 16, 2006.

(51) Int. Cl.
*A62C 5/02* (2006.01)

(52) U.S. Cl. ..... 239/10; 239/68; 239/74; 239/310; 239/318; 239/525; 222/566

(58) Field of Classification Search ..... 239/67, 239/68, 74, 310, 318, 525; 222/566
See application file for complete search history.

(56) References Cited

U.S. PATENT DOCUMENTS 2,404,548 A * 7/1946 Thomas ..... 137/469
3,254,844 A * 6/1966 Blasnik et al. ..... 239/318
3,829,023 A * 8/1974 Bouillard et al. ..... 239/318
4,369,921 A * 1/1983 Beiswenger et al. ..... 239/317
6,726,123 B2 * 4/2004 Wang ..... 239/310

* cited by examiner

*Primary Examiner*—Dinh Q Nguyen
(74) *Attorney, Agent, or Firm*—Rosenberg, Klein & Lee

(57) ABSTRACT

A system and method are provided for selectively dosing and dispensing a predetermined liquid material in and from a pre-dispensing measuring sight glass container vessel, wherein a housing is disposed to receive a pressurized fluid stream, to provide an intermediate measurement and storage vessel for the liquid material and to provide a selectively operable valve assembly that is disposed in a flow path defined in the housing. The housing includes an inlet, an outlet, and an intermediate portion extending therebetween, which is formed with an admission port for admitting the predetermined liquid material. The valve assembly is disposed between the housing's inlet and outlet, and may be selectively operated to fill the sight glass container from the source container; or, to dispense the liquid material from the sight glass container; or, to clean the sight glass container; or, to just provide a flow of the pressurized fluid without any liquid material. At no selection or operating condition can liquid material from the source container be dispensed without first being measured into the sight glass container.

18 Claims, 31 Drawing Sheets

SECTION B-B

"CLEAN"

"RINSE"

"DISPENSE"

SYSTEM AND METHOD FOR CONTROLLED DOSING AND DISPENSING OF LIQUID MATERIAL

RELATED APPLICATION DATA

This Application is based on U.S. Provisional Application No. 60/782,537, filed 16 Mar. 2006.

BACKGROUND OF THE INVENTION

1. Field of the Invention

The present invention is generally directed to the controlled dosing and accuracy in dispensing of liquid materials. More specifically, it is directed to the proper dosing and accuracy in the distribution or application rate of the liquid materials onto surfaces to be treated. The present invention is directed, moreover, to a system and method by which proper dosing and dispensing is effected in a manner that allows feedback to the user relative to the intended application rate of the liquid material.

Dispensing control devices of the type used with a pressurized stream of fluid, such as water provided through a conventional garden hose, pump-up tank sprayer or other delivery means, are widely used in many applications. One example is a spray nozzle attachment for a garden hose which serves also as a dispensing assembly and capping means for a container of fertilizer, weed/pest control, or other highly concentrated lawn or garden treating chemical. Another example of the many applications is a sprayer attachment which controls the sprayed dispensing of liquid material from an air pump-type container.

Each of these dispensing applications and indeed each different liquid material to be diluted and dispensed will require a specific dilution ratio and will also require a specific application rate. That is, the amount of diluted liquid material (at the proper dilution ratio) to be delivered to some area of the surface to be treated. In most instances, the end user is given instruction to mix the liquid material at a rate of xx ounces per gallon of water and then apply yy gallons of water per zz square feet of surface to be treated—for example mix 1.5 ounces of a liquid material to 3 gallons of water and apply this at a rate of 10 gallons per 100 square feet of lawn. For the average user, this is quite complicated to understand and typically they will overdose to be sure they do the job well. However, many of the concentrated liquid materials contain toxins, that when used in excess provide no additional benefit, but are prone to runoff and to percolate into the ground, possibly contaminating wells or water supplies. In the case of the hose-end sprayer apparatus connected to the container of concentrated liquid material, the user needs to do far less math to accomplish the task as the dilution rate is predetermined by the inner fluidic arrangement in the sprayer head. However, the user is still instructed to apply some quantity of diluted liquid material to some quantity of area to be treated. Again, the user is left without any means to know exactly how much of the substance has been utilized as the operation progresses and hence the user tends to over-apply the product. Most users simply keep spraying the diluted liquid material until the container is emptied—thinking more is better.

There exists, therefore, a need for an approach to dispensing a liquid material which provides the user an easy method for applying the correct volume of liquid material to an easy to estimate quantity of area to be treated. In addition, there exists a need for an apparatus to support the method and system, allowing the user a feedback means to achieve the proper dosing rates per a given area to be treated.

2. Prior Art

Closure devices for liquid product containers are known in the art, as are devices for controlling the dispensing of liquid products from containment. The best prior art known to Applicant include: U.S. Pat. Nos. 3,863,843; 4,244,494; 5,996,700; 4,971,105; 4,527,740; 5,007,588; 4,811,900; 4,508,272; 4,901,923; 5,375,769; 6,471,141; 6,435,773; 5,388,767; 4,142,681; 6,012,650; 5,533,546; 5,881,955; 3,940,069; 3,929,150; 3,763,888; 3,561,680; 4,176,680; 4,883,086; 4,105,044; 4,142,545; 4,154,258; 4,197,872; 4,775,241; 5,799,688; 4,047,541; 5,039,016; 5,100,059; 5,213,265; 5,320,288; 5,372,310; 5,383,603; 6,283,385; 6,378,785; 6,578,776; 4,826,085; 5,303,853; 3,666,150; 5,213,129; 5,129,730; 2,770,501; 5,293,946; 5,085,039; 2,988,139; 4,971,105; 3,863,843; 372,503; and, RE29,405. Such devices fail to provide the unique combination of features and advantages for failsafe closure and controlled dispensing of liquid materials to the degree provided by the present invention.

Numerous concentrated liquid products are now manufactured and sold in a retail environment in ready-to-use packaged containers (including bottles). Many are capped with sprayer type dispensing mechanisms configured for attachment to the end of a hose. Such sprayer type mechanisms serve to dilute the concentrated liquid product as it is dispensed, by an appropriate mixture ratio with the pressurized stream of water emerging from the hose. They serve also to expel the diluted mixture for appropriate application. Examples of uses widely found for this type of storage and dispensing of liquid products include lawn or garden care and weed/pest control, automobile cleaning, structural siding material cleaning, and so on.

These are relatively simple to use, however the application rate is often difficult to calculate and harder to understand depending on the actual flow rates encountered. Variations in water supply pressures result in variations in flow rates, different hose configurations and attachments vary the flow rates, elevation changes will result in a variation in flow rates. Hence, any instruction to a use based on flow rates—(apply 10 gallons of diluted product to 100 square feet of lawn) is nearly impossible for the homeowner to follow. So, homeowners do the next best thing, they guess and apply a bit more to make sure—resulting in over usage of possible harmful chemicals.

Hence, there remains a need for a system and method to allow the user to apply a certain known volume of the chemical to an estimated area of surface to be treated—independent of how much water is used to deliver the chemical onto the surface. Thereby freeing the user to simply deliver the correct volume of chemical (at some flow rate and dilution ratio determined by the available water source and available plumbing) to the estimated given area without the need to understand the flow rate or the time required or to calculate the ratio or total number of gallon delivered. This results in more efficient use of the chemical liquid material, more cost effective use of the product, reliability in results from the use of the liquid material and less chance of over usage and excess runoff polluting the water table and waterways.

SUMMARY OF THE INVENTION

It is a primary object of the present invention to provide an apparatus, system and method for controlled dosing and dispensing of a liquid material which enables the end-user to achieve the correct rate of application.

It is another object of the present invention to provide an apparatus, system and method which provides an intuitive visual feedback feature to impart application rate information to the end-user as the liquid material is being dispensed.

It is another object of the present invention to provide a system and method for controlled dosing and dispensing of the liquid material which can be used by a user without measuring the liquid material, thereby protecting the user from coming into physical contact with the concentrated liquid material.

It is yet another object of the present invention to provide an apparatus to support the system and method that can be produced in a cost effective manner and that will be durable enough to satisfy the dosing and dispensing requirements for dispensing the entire contents of the affixed source container.

These and other objects are attained in accordance with the present invention in a system and method for controlled dosing and dispensing of a predetermined liquid material from a source container. The system generally comprises a housing for receiving a pressurized fluid stream, a measuring container for holding the volume of liquid material to be dispensed and a selectively operable valve assembly disposed in a flow path defined therein. The housing includes an inlet, an outlet, and an intermediate portion extending therebetween, which is formed with an admission port for admitting the predetermined liquid material, a sight glass style containment vessel, a flow control valve and a function selection valve assembly. The flow control valve assembly is disposed between the housing's inlet and outlet, and may be selectively operated to alternatively permit or to stop the flow of the pressurized fluid through the housing. The function selection valve assembly is disposed between the housings inlet and outlet, and may be selectively operated to choose one of at least four functions available to the user.

In accordance with one aspect of the present invention, various embodiments incorporate a method for selectively and accurately dosing and dispensing a predetermined liquid material which generally comprises among its combination of steps that of establishing a first source containing the predetermined liquid material and establishing a second source of a pressurized fluid stream. The method also includes the steps of attaching a housing to the first and second sources for receiving the pressurized fluid stream and controlling said pressurized fluid stream with said flow control valve means. The housing defines an admission port for selectively admitting the predetermined liquid material therethrough, as well as a flow path for the pressurized fluid stream and the sight glass style containment vessel. The method further includes the step of selectively operating a function selection valve assembly disposed in the housing's flow path, the function selection valve assembly being selectively operated to choose one of a plurality of selectable four possible functions, such as: clean, rinse, fill and dispense. When the pressurized fluid stream is directed into the flow path, the function selection valve assembly creates a low pressure condition and directs a portion of the pressurized fluid stream to provide means to accomplish each of the four functions. The method also includes the steps of filling the sight glass using the fill function and then dispensing from the sight glass, mixing with the fluid stream to dilute the liquid material and then to dispense the mixture onto a predetermined area of a surface to be treated. The method includes visual use of the sight glass as a feedback mechanism to the user for knowledge about the quantity of liquid material dispensed or available to be dispensed to the predetermined area of surface to be treated. Further, the method includes the use of the clean function to provide a rinse and flush operation to prepare the apparatus for storage until the next use is required.

BRIEF DESCRIPTION OF THE DRAWINGS

FIG. 3 is a front perspective exploded view of the embodiment shown in

FIG. 1;

DETAILED DESCRIPTION OF THE PREFERRED EMBODIMENTS

Figure 1:
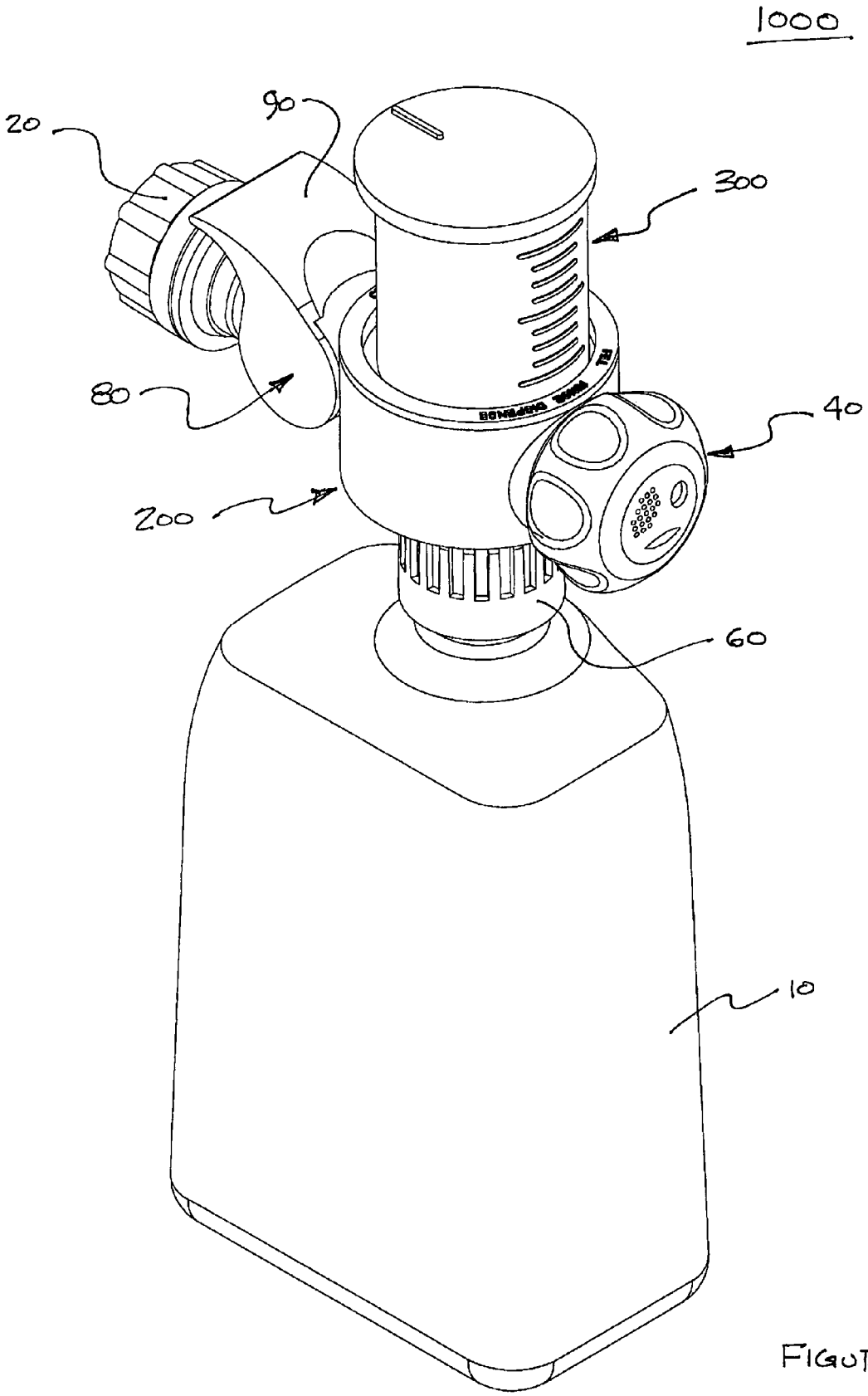
FIG. 1 is a front perspective exterior view of one embodiment of a system formed in accordance with the present invention, with the selection control set to the CLEAN position and the flow control in an OFF or no flow configuration.
Figure 2:
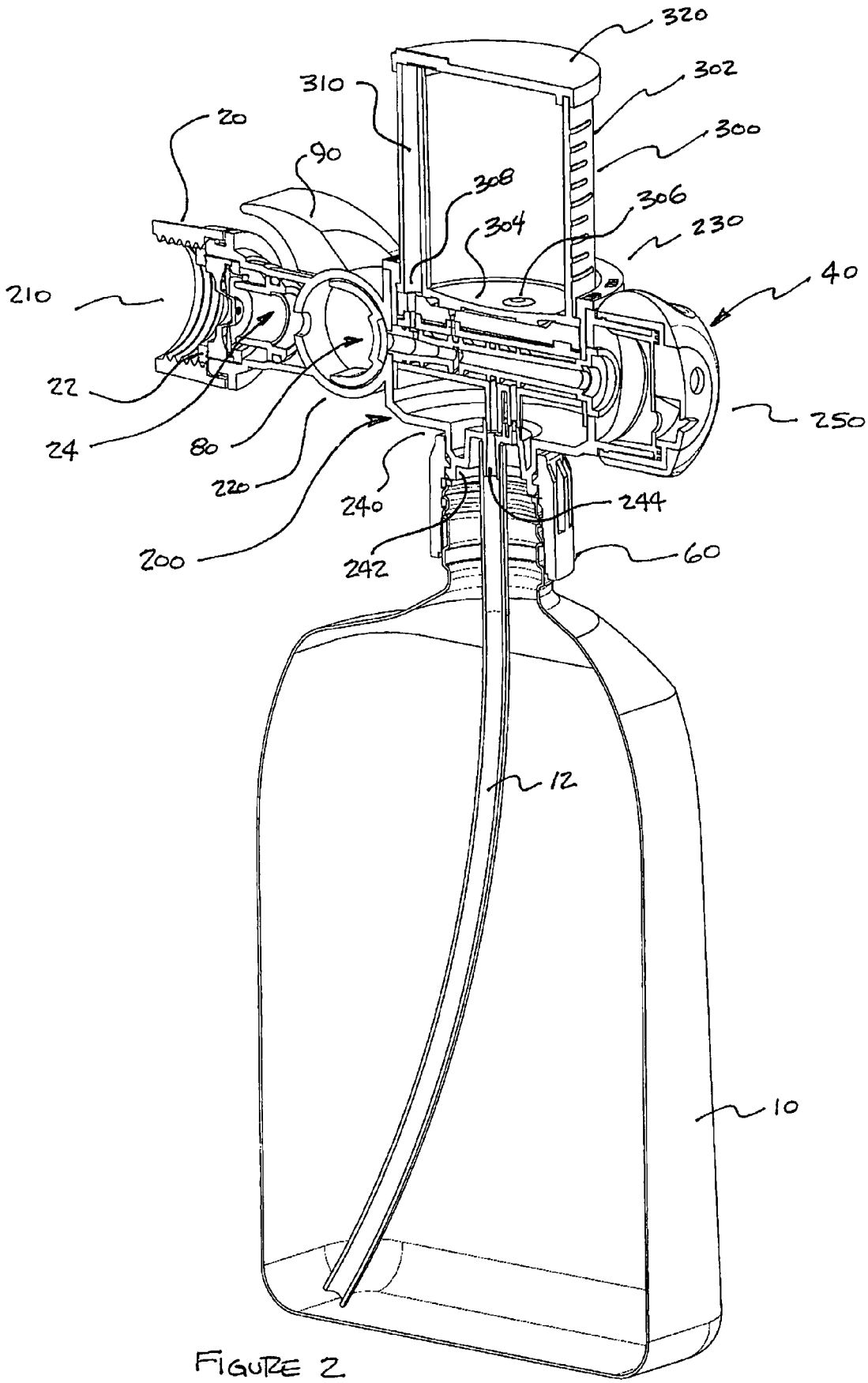
FIG. 2 is a front perspective sectional view corresponding to the embodiment as illustrated in FIG. 1.
Figure 3:
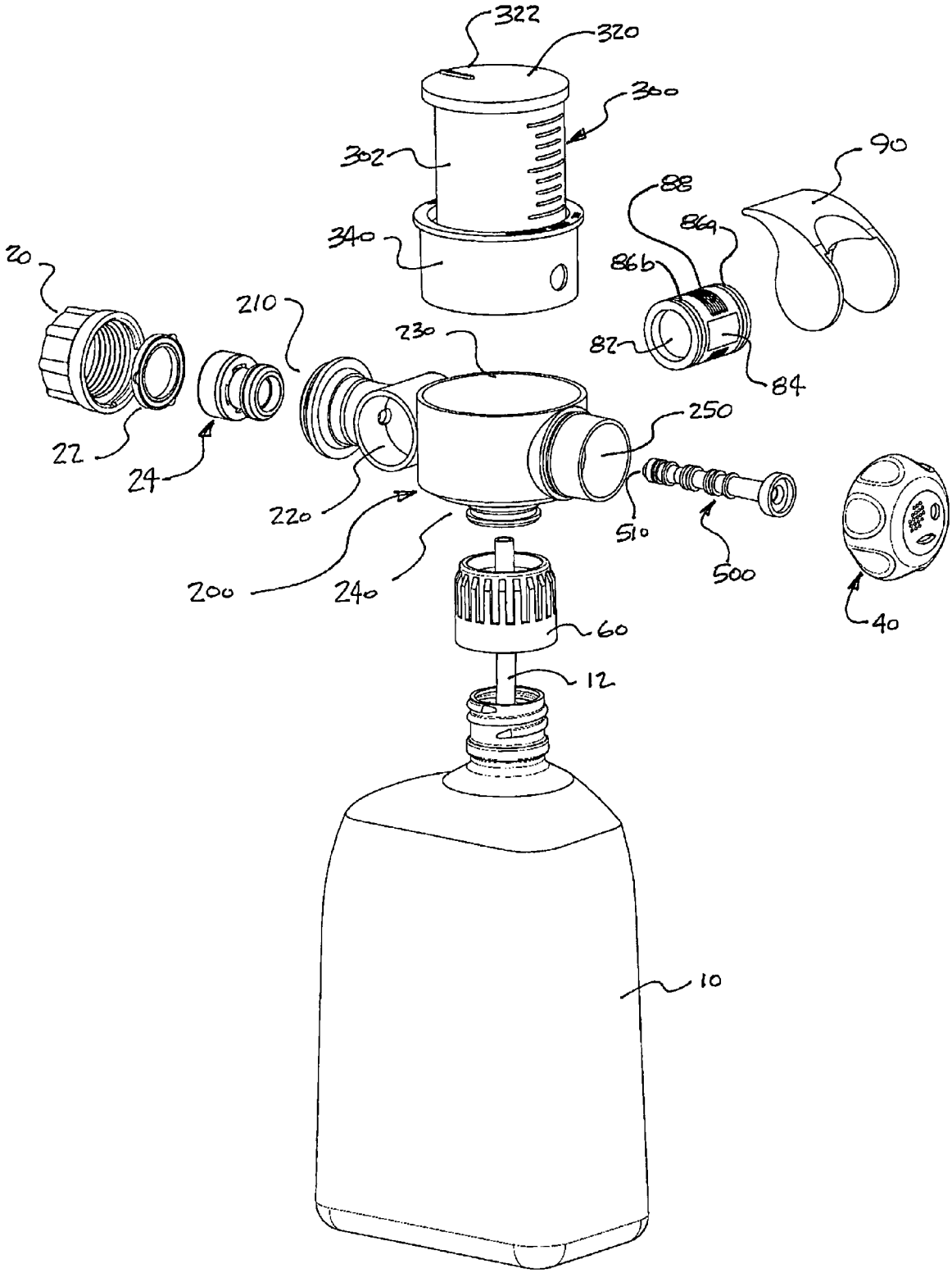
Figure 4:
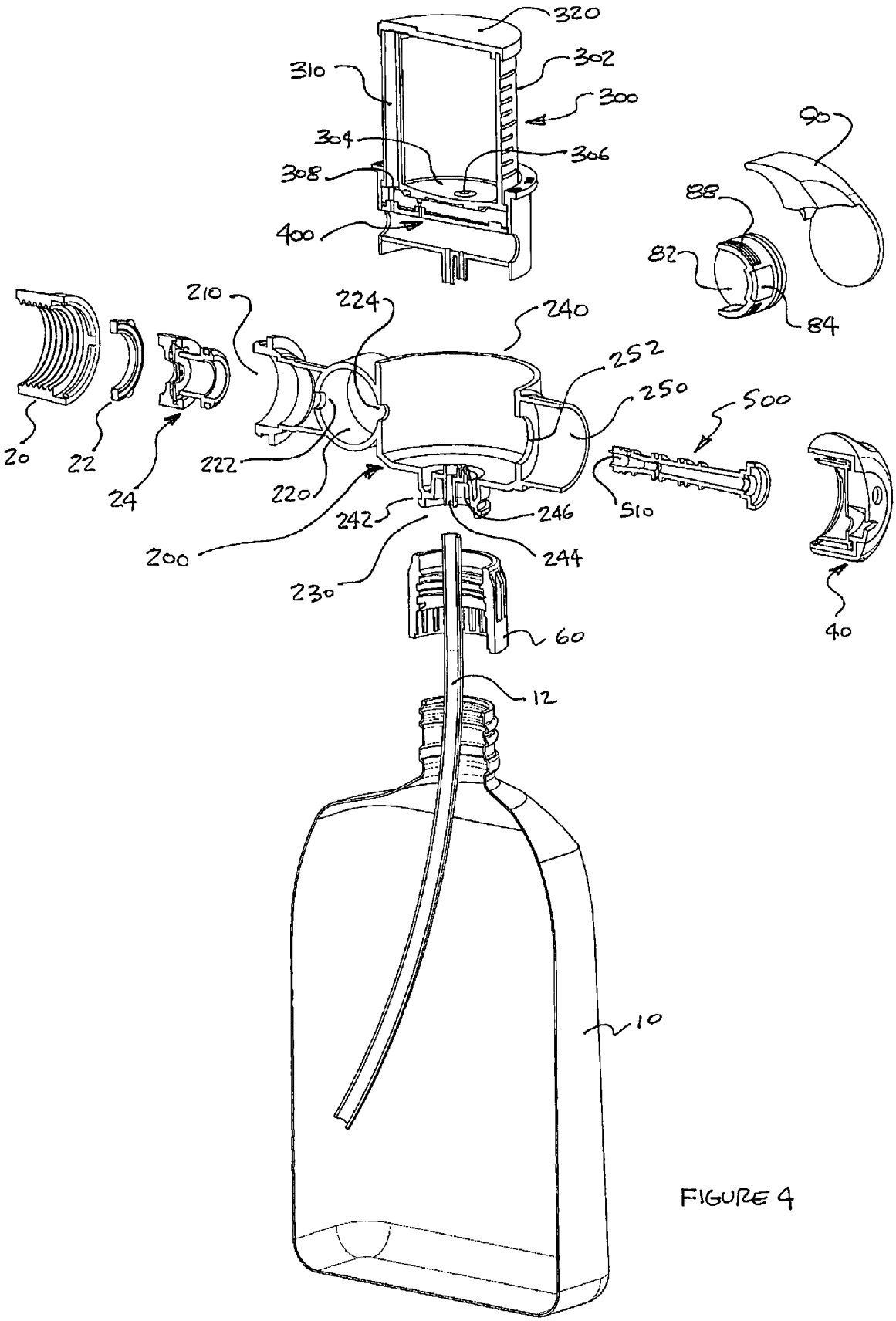
FIG. 4 is a front perspective exploded sectional view corresponding to the embodiments as illustrated in FIG. 3.
Figure 5:
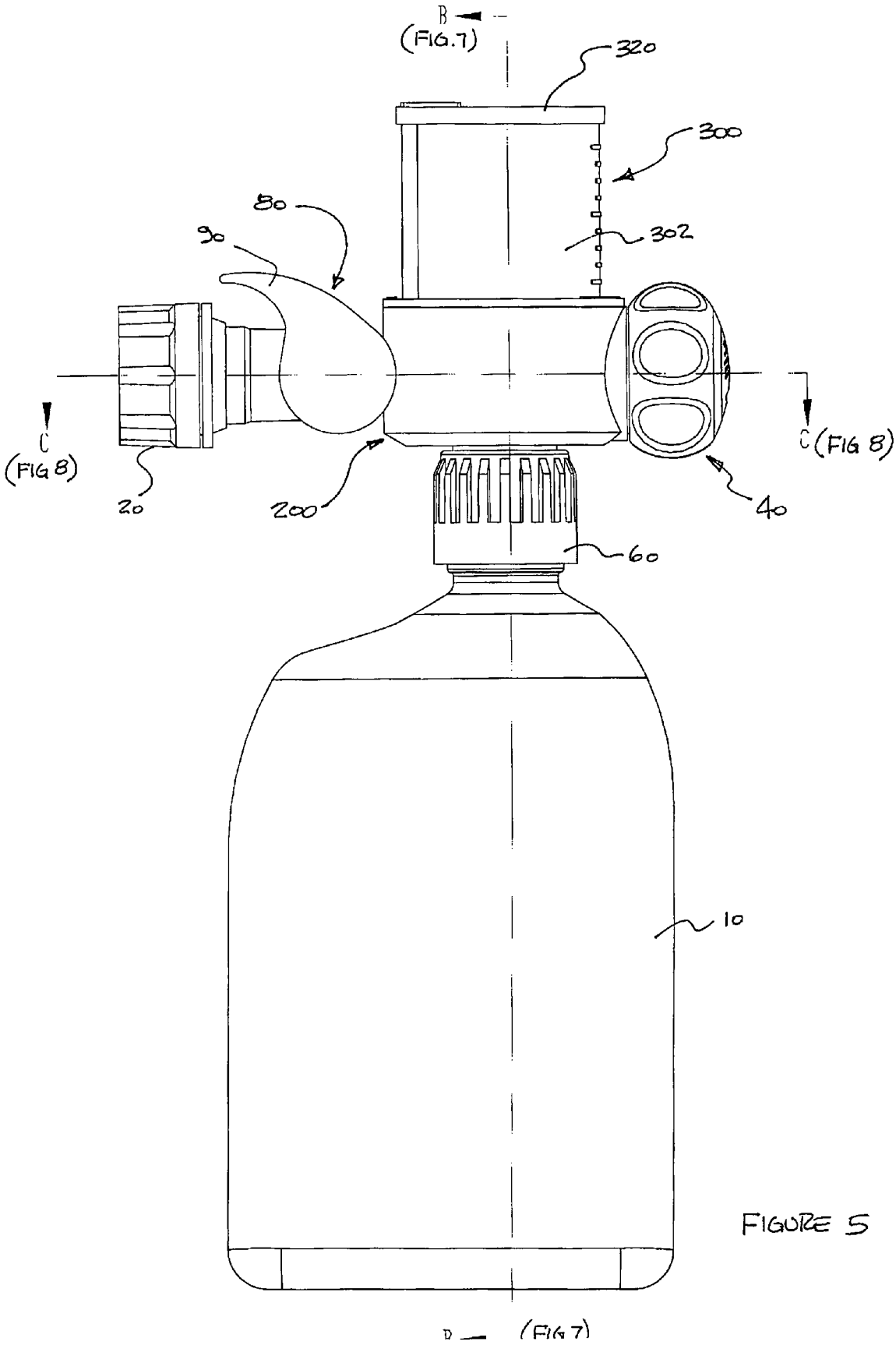
FIG. 5 is a font view corresponding to the embodiments as illustrated in FIG. 1.
Figure 6:
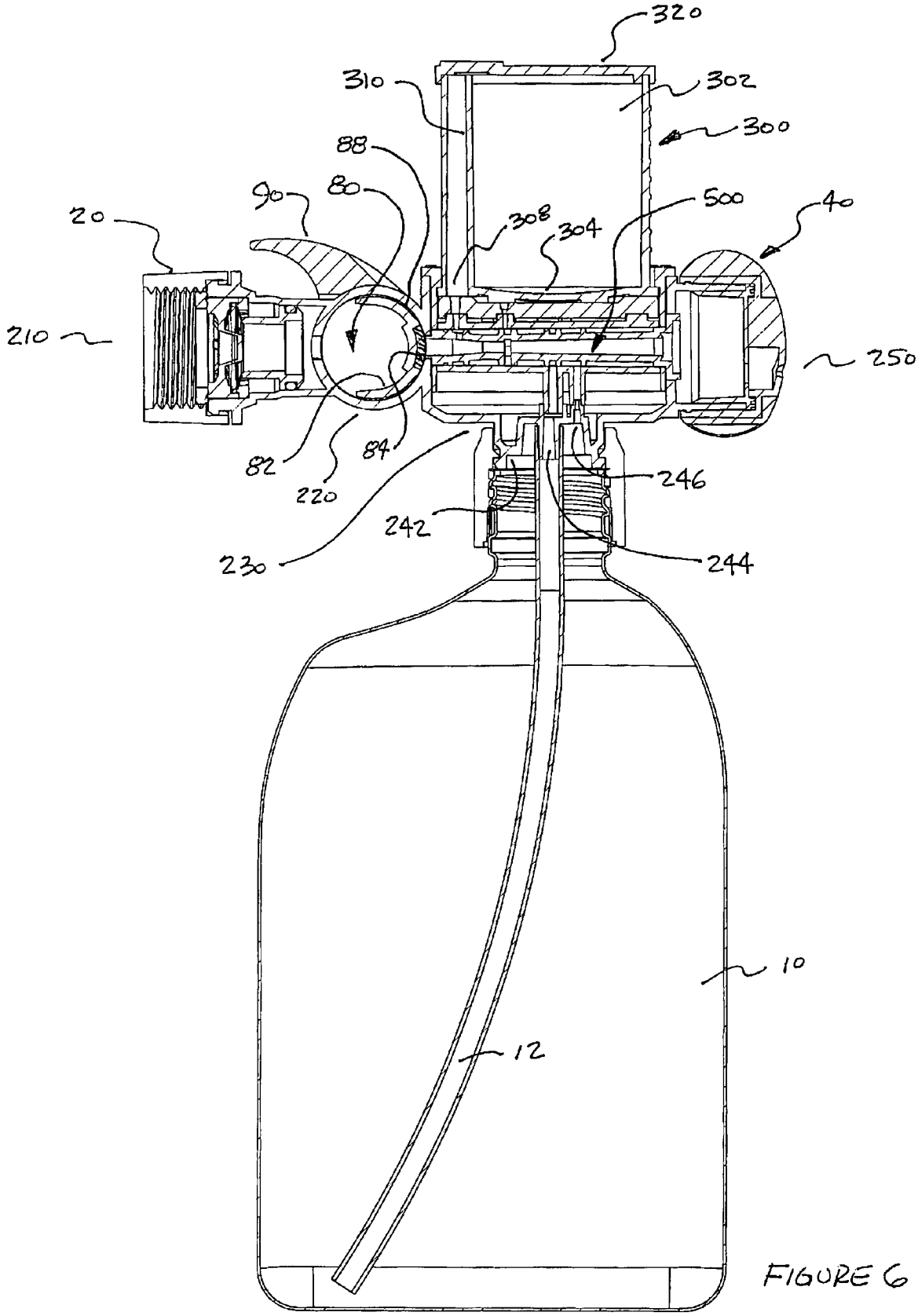
FIG. 6 is a front sectional view corresponding to the embodiments as illustrated in FIG. 5.
Figure 7:
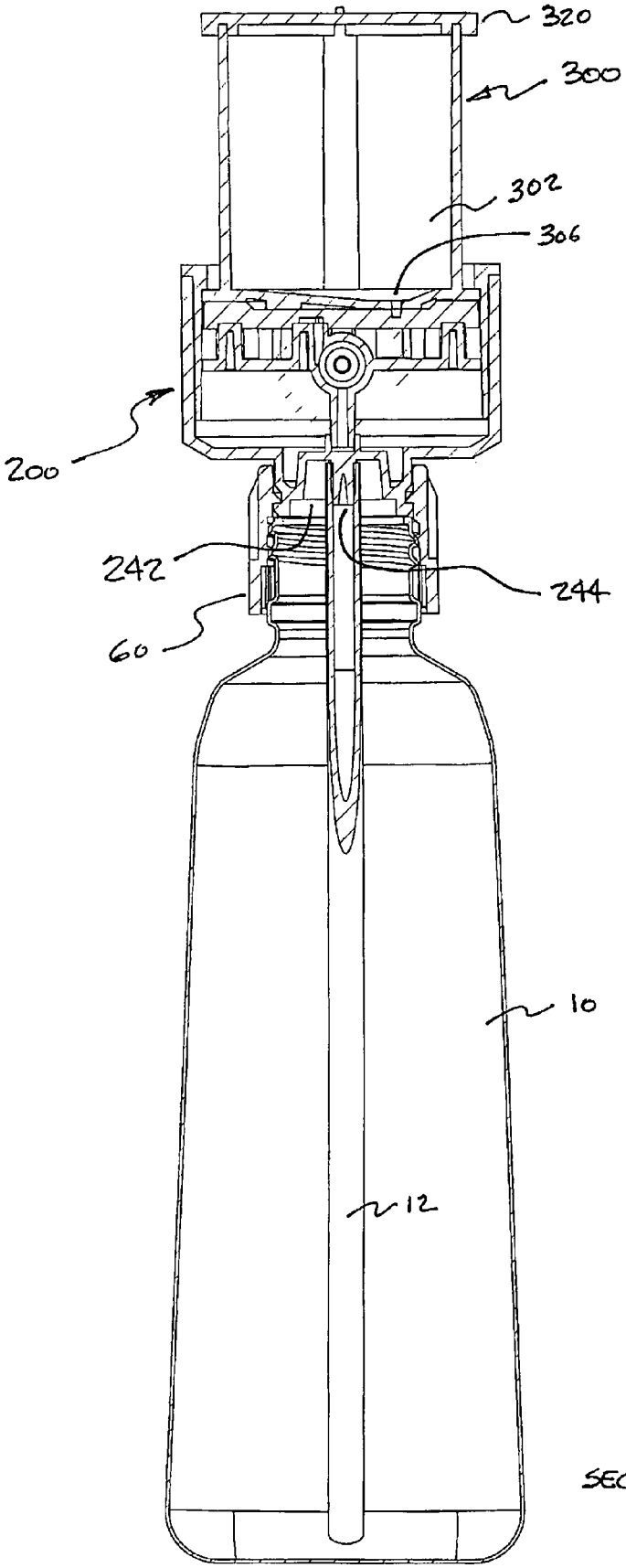
FIG. 7 is a transverse cross sectional view as taken from the embodiments as illustrated in FIG. 5.
Figure 8:
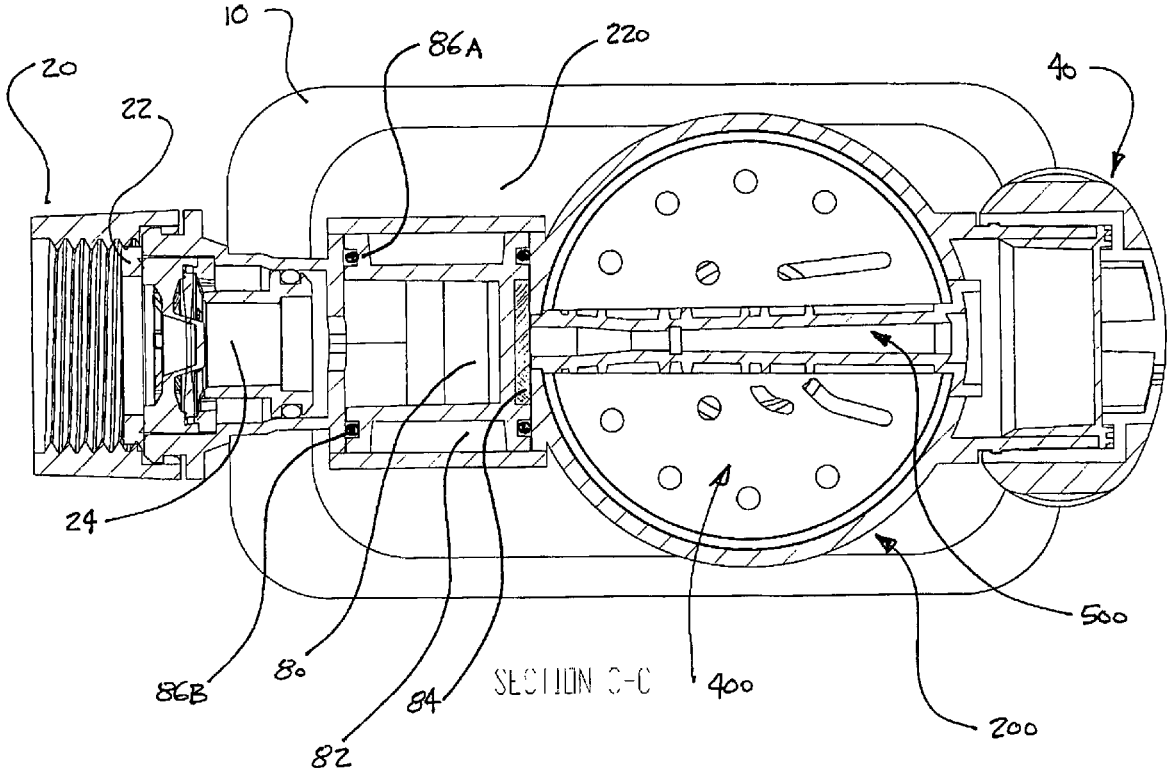
FIG. 8 is a horizontal cross sectional view corresponding to the embodiment as illustrated in FIG. 5.

In overall operation, the controlled accurate dosing and dispensing system of the present invention serves to control the safe rate of application of liquid materials, which may be potentially hazardous. It safeguards against the accidental or uneducated overdosing or over application of the liquid material by operably coupling to the liquid material's source a pre-dispensing measuring sight glass container and valve assembly which is properly filled with liquid material from the source container for properly segregating just that portion of the liquid material to be dispensed from the apparatus. This pre-dispensing measuring sight "glass" container (which may or may not actually be formed of a glass material per se) and valve assembly is situated for easy viewing by the user and is suitably marked with volumetric graduations, such that the user can understand the total volume of concentrated liquid material delivered or yet to be delivered. This dosing and dispensing system is used in conjunction with an overall process for treating a given area of surface, whereby given a standard area to be covered by a certain volume of the concentrated liquid material the user determines the area then fills the pre-dispensing measuring sight glass container, proceeding thereafter to dilute and apply the liquid material to the predetermined area. Once the contents of the pre-dispensing measuring sight glass container are completely exhausted, distributed over the predetermined area, the correct application rate would have been accomplished, without regard to the total volume of water used. Hence, the user achieves the correct application rate without calculating time or water volume.

In many applications, a pressurized flow of water or other fluid is necessary in any event at the time of the liquid material's dilution, dispensing and use. In typical lawn and garden applications, for instance, the contained liquid material may be a highly concentrated fertilizer, insecticide, weed killer, or other such chemical formulation requiring a stream of water for dilution and/or transport. In the present invention this availability of pressurized water is utilized to provide a number of different functions. First, the flow of water can be used in conjunction with a venturi to create a lower than atmospheric pressure condition in the pre-dispensing measurement sight glass container and when selectively positioned by the user this low pressure condition can be used to fill the pre-dispensing measurement sight glass container with liquid material from the source container. Stopping the flow of water during this filling operation stops the pressure differential thereby affording the user a means for filling the pre-dispensing measurement sight glass container with a degree of accuracy. Second, the pressurized water is used to again in conjunction with a venturi create a lower than atmospheric pressure condition in the venturi mixing chamber When selectively positioned by the user this low pressure condition can be used to withdraw liquid material from the pre-dispensing measurement sight glass container and introduce it into the flowing water stream to dilute the liquid material and then to dispense it through the nozzle, onto the surface to be treated. Third, the pressurized water can be selectively flowed through the venturi without utilizing the resulting lower than atmospheric condition for anything and simply provide a stream of pure water out through the nozzle onto the surface to be treated for pre-wetting a surface, rinsing the surface and the like. Fourth, since the concentrated liquid product might have particulate matter in suspension or might contain other chemicals that may form deposits potentially causing performance problems with the dispenser, the pressurized water can be used, upon selection by the user to fill the pre-dispensing measuring sight glass container with water and simultaneously withdraw the contents of the pre-dispensing measuring sight glass container in an effort to clean the residue after use; effectively a flushing cleaning operation. The user selection device and valves associated therewith are arranged in such a manner that liquid product cannot be drawn from the source container into the dispensed stream; only liquid product from within the pre-dispensing measuring sight glass container can be introduced into the stream of water for dilution and dispensing through the nozzle and onto the surfaces to be treated. In this manner the user can readily know and understand the portion of liquid material dispensed relative to the predetermined area treated, without regard to total volume of mixture dispensed or flow rate of the mixture or the time of the application.

Referring now to FIGS. 1-31, there is shown one exemplary embodiment of a dosing and dispensing system 1000 for the accurate dosing and dispensing of a liquid material from its container or other storage source. In the disclosed embodiment, the system is of the type which invokes an aspiration-based technique (exploiting a Venturi effect or the like) to draw the liquid material from its container for premeasuring, mixing and delivery to the targeted surface area, organism or material. This is but one example of numerous embodiments in which the accurate dosing and dispensing system 1000 may be realized in accordance with the present invention.

In the illustrative embodiment shown, system 1000 is formed as a sprayer attachment of a type typically fitted to the end of a garden hose, which expels with the fluid stream supplied by the hose a liquid material drawn from an attached holding container 10. As such, system 1000 generally comprises a housing 200 preferably having a hose coupling 20 connected at its inlet 210, a spray nozzle 40 connected at its outlet 250, a rotatable threaded container connector 60 connected at an midsection bottom portion 240, a fluid flow control valve 80 assembled within housing midsection 220, and a sight-glass style container 300 assembled within housing midsection top portion 230. An intermediate portion 240 of the housing 200 is formed with a coupling structure 242 which surrounds and extends from an admission port 244. An adapter 60 is preferably provided at a neck portion of the coupling structure 242 to facilitate attachment of, for example, a bottle-like container 10 supplying the given liquid material. During use, when selected for filling the sight glass container 300 the liquid material is drawn through the admission port 244 via the suction tube 12 extending to the bottommost surfaces of container 10 and into the internal function selection valve assembly 400 for directing the flow to the proper port for filling the sight glass container 300.

Devices such as the hose washer gasket 22, the back-flow prevention device 24 and spray nozzle 40 are shown in the FIGS. for illustrative purposes only, as they are not important to the present invention. The structure and function of such devices are well known to those skilled in the art, are not further described herein. Moreover, in the interest of brevity and clarity, they are not necessarily shown in the FIGS. in precise configurational detail.

Figure 13:
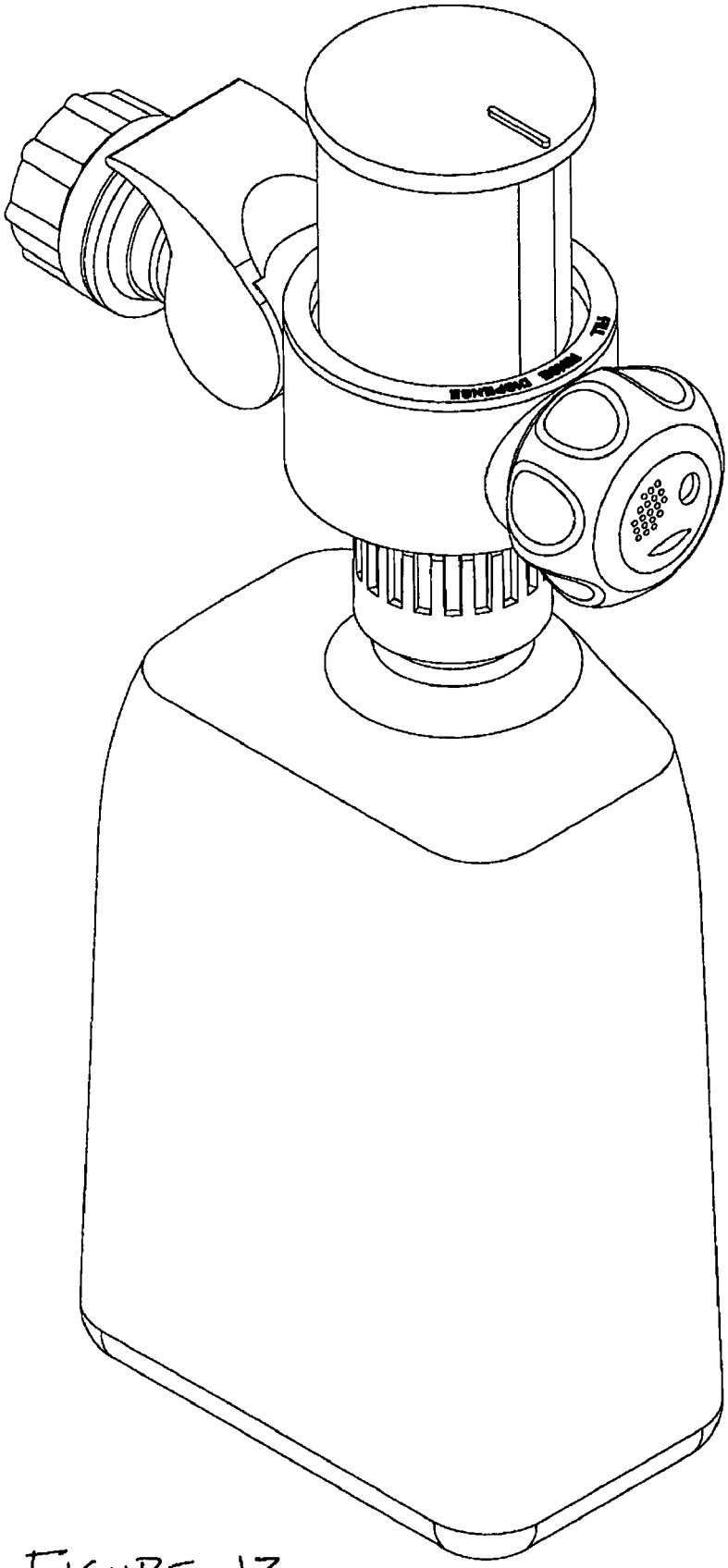
FIG. 13 is a front perspective exterior view of one embodiment of a system formed in accordance with the present invention, with the selection control set to the RINSE position and the flow control in an OFF or no flow configuration.
Figure 14A:
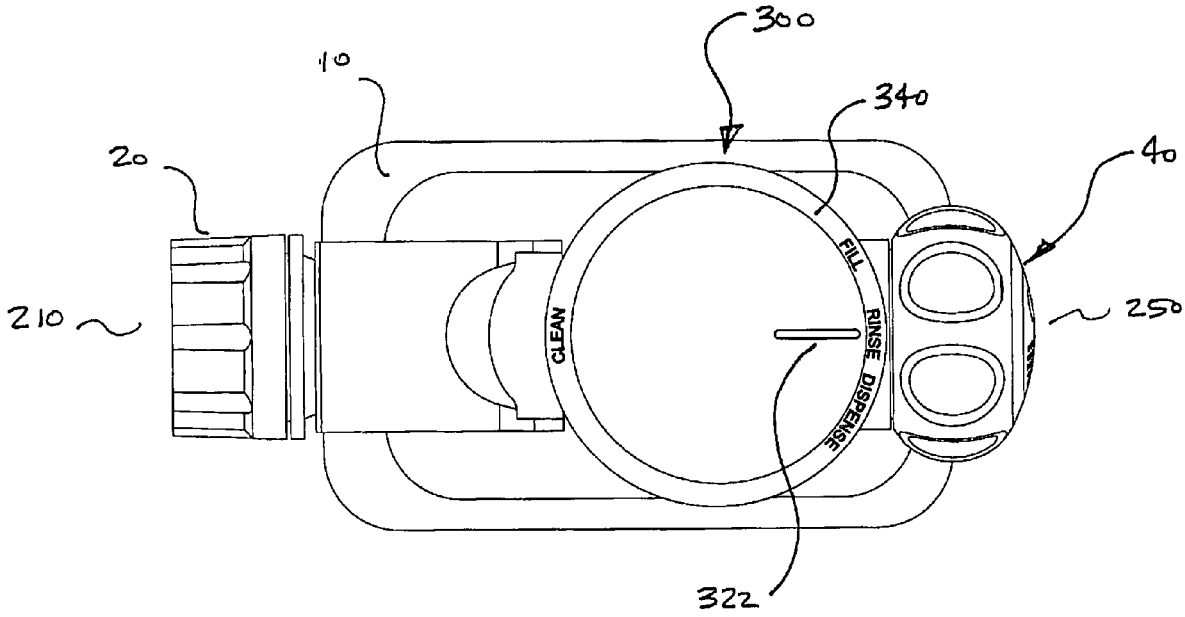
FIG. 14*a* is a top view of the embodiment as shown in FIG. 13, as set to the RINSE setting.
Figure 14B:
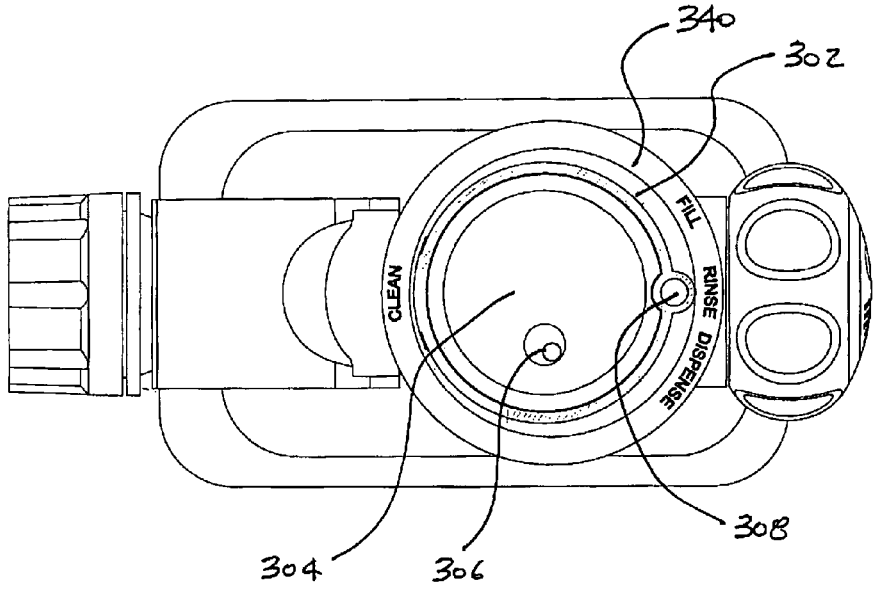
FIG. 14*b* is a top sectional view of the embodiment as shown in FIG. 14*a*, highlighting the alignment of the flow ports relative to the selection indicia.
Figure 15:
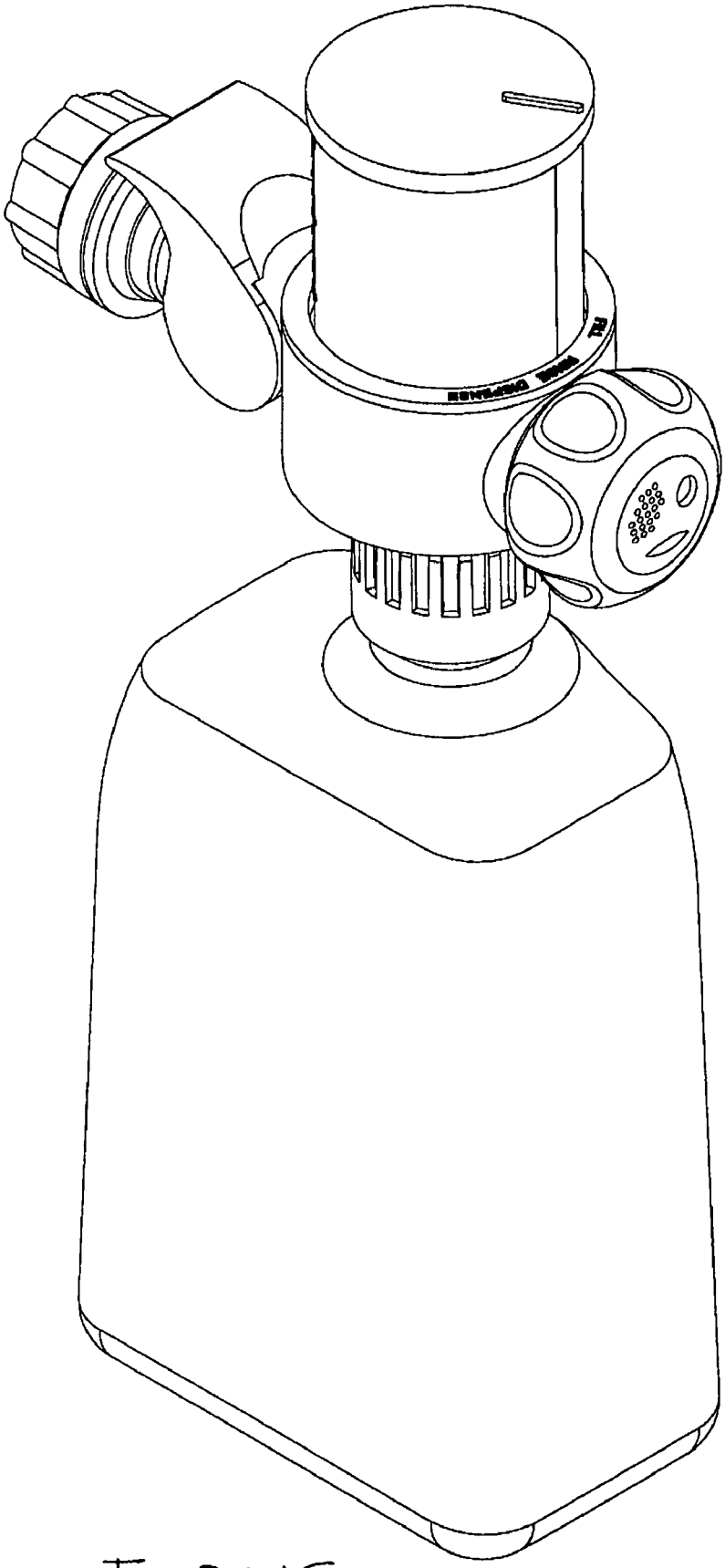
FIG. 15 is a front perspective exterior view of one embodiment of a system formed in accordance with the present invention, with the selection control set to the FILL position and the flow control in an OFF or no flow configuration.
Figure 16A:
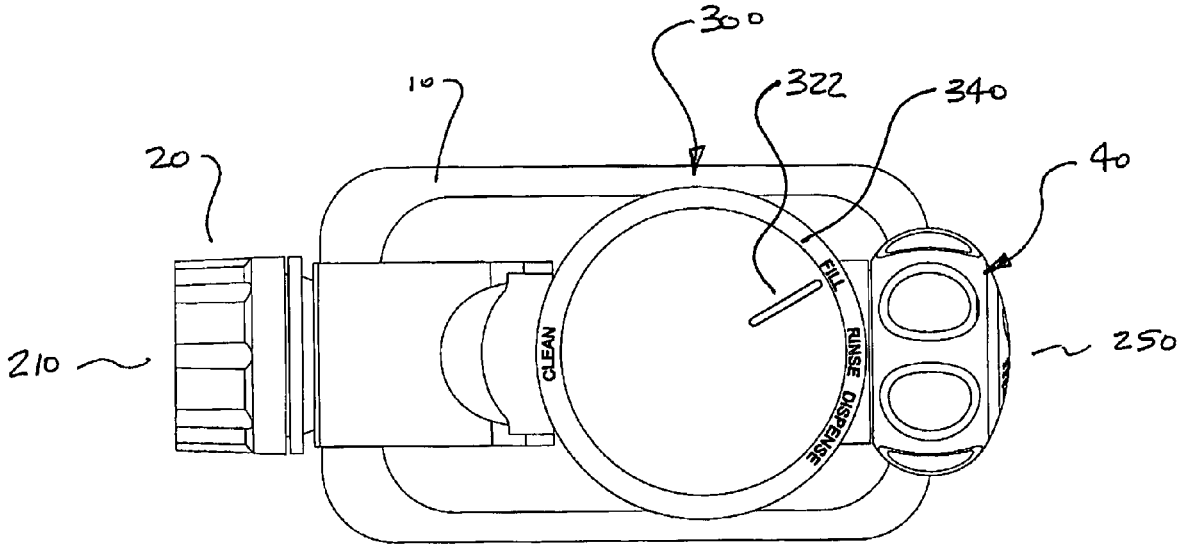
FIG. 16*a* is a top view of the embodiment as shown in FIG. 1, as set to the FILL setting.
Figure 16B:
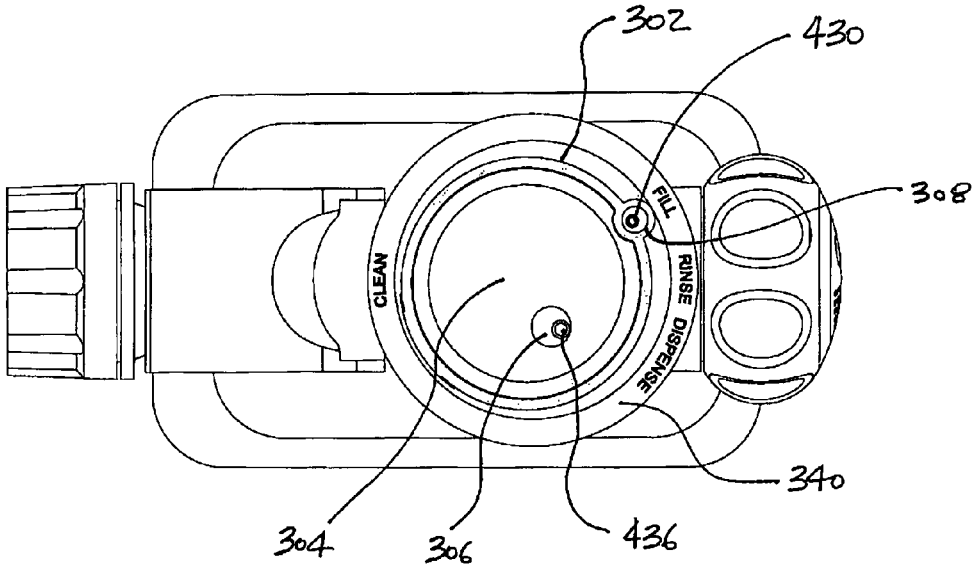
FIG. 16*b* is a top sectional view of the embodiment as shown in FIG. 16*a*, highlighting the alignment of the flow ports relative to the selection indicia.
Figure 17:
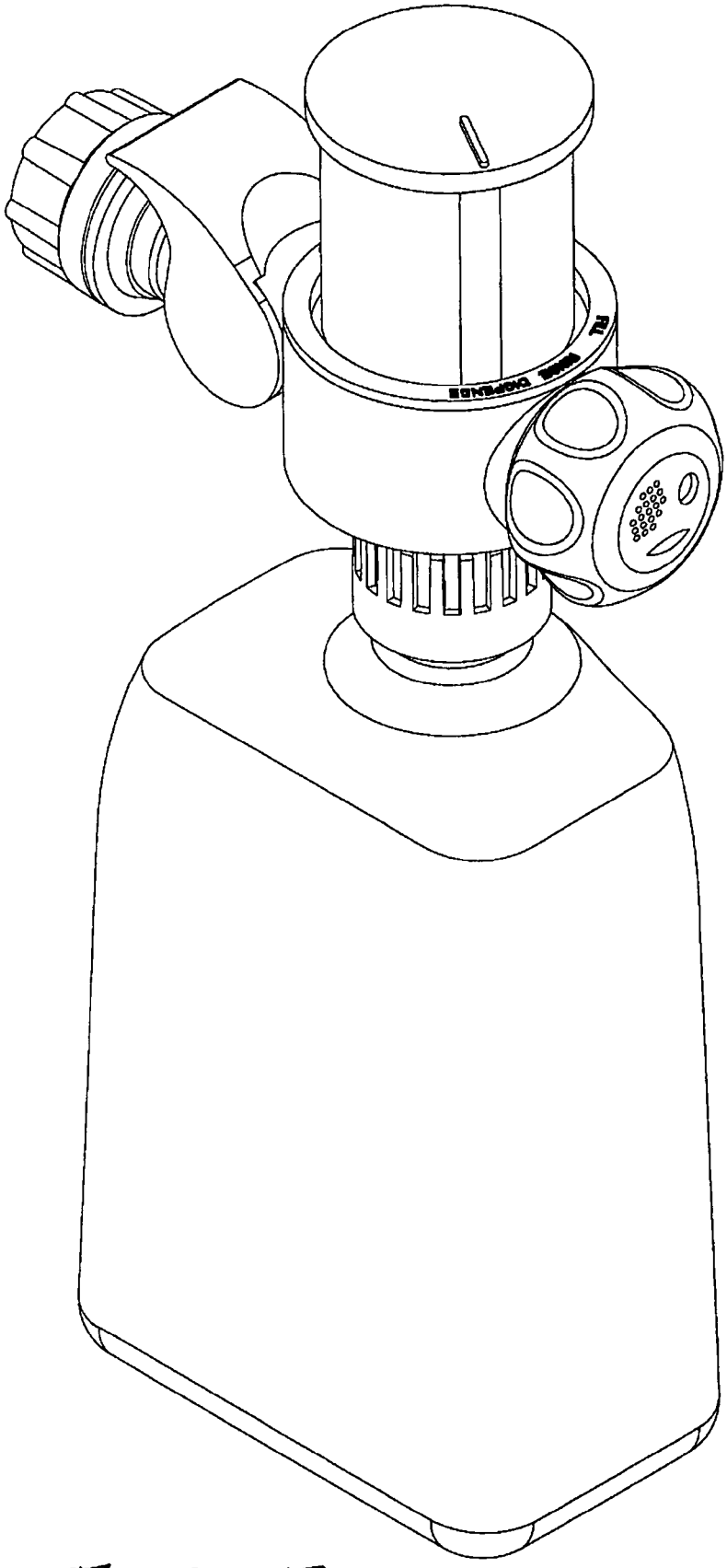
FIG. 17 is a front perspective exterior view of one embodiment of a system formed in accordance with the present invention, with the selection control set to the DISPENSE position and the flow control in an OFF or no flow configuration.
Figure 18A:
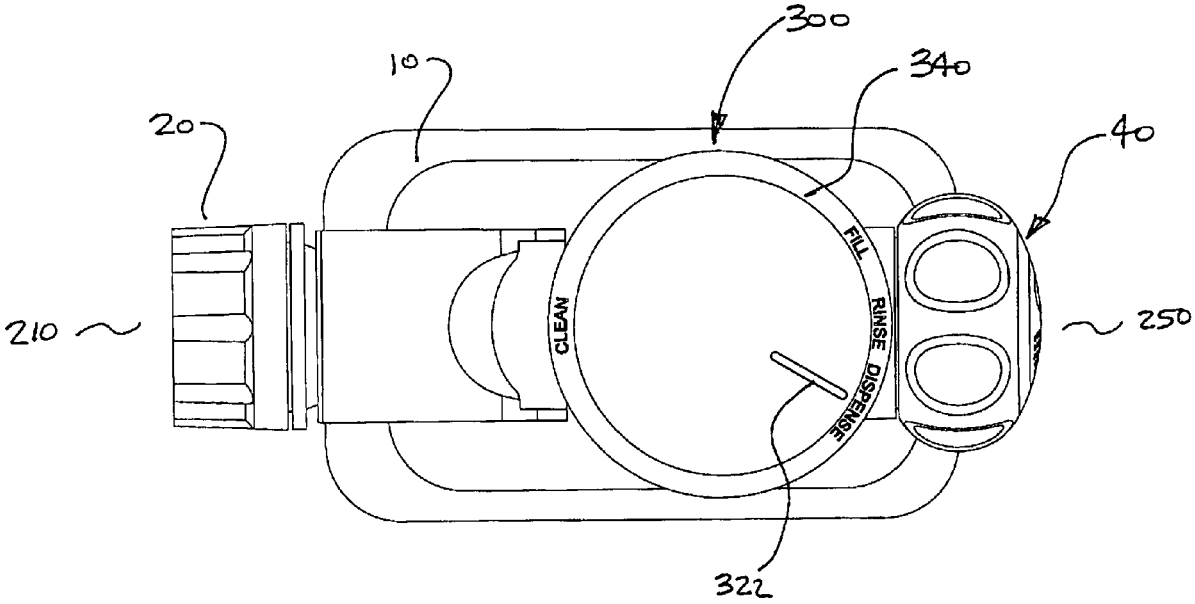
FIG. 18*a* is a top view of the embodiment as shown in FIG. 17, as set to the DISPENSE setting.
Figure 18B:
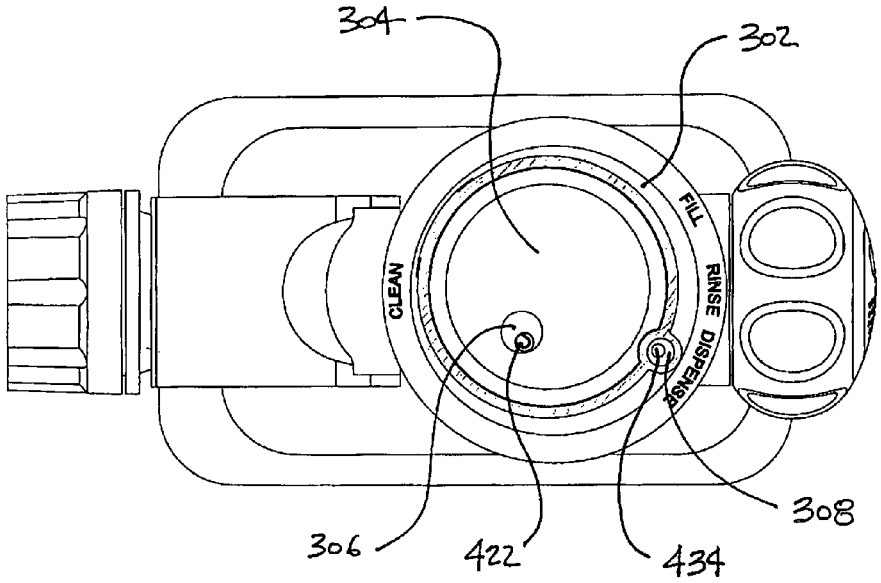
FIG. 18*b* is a top sectional view of the embodiment as shown in FIG. 18*a*, highlighting the alignment of the flow ports relative to the selection indicia.
Figure 19:
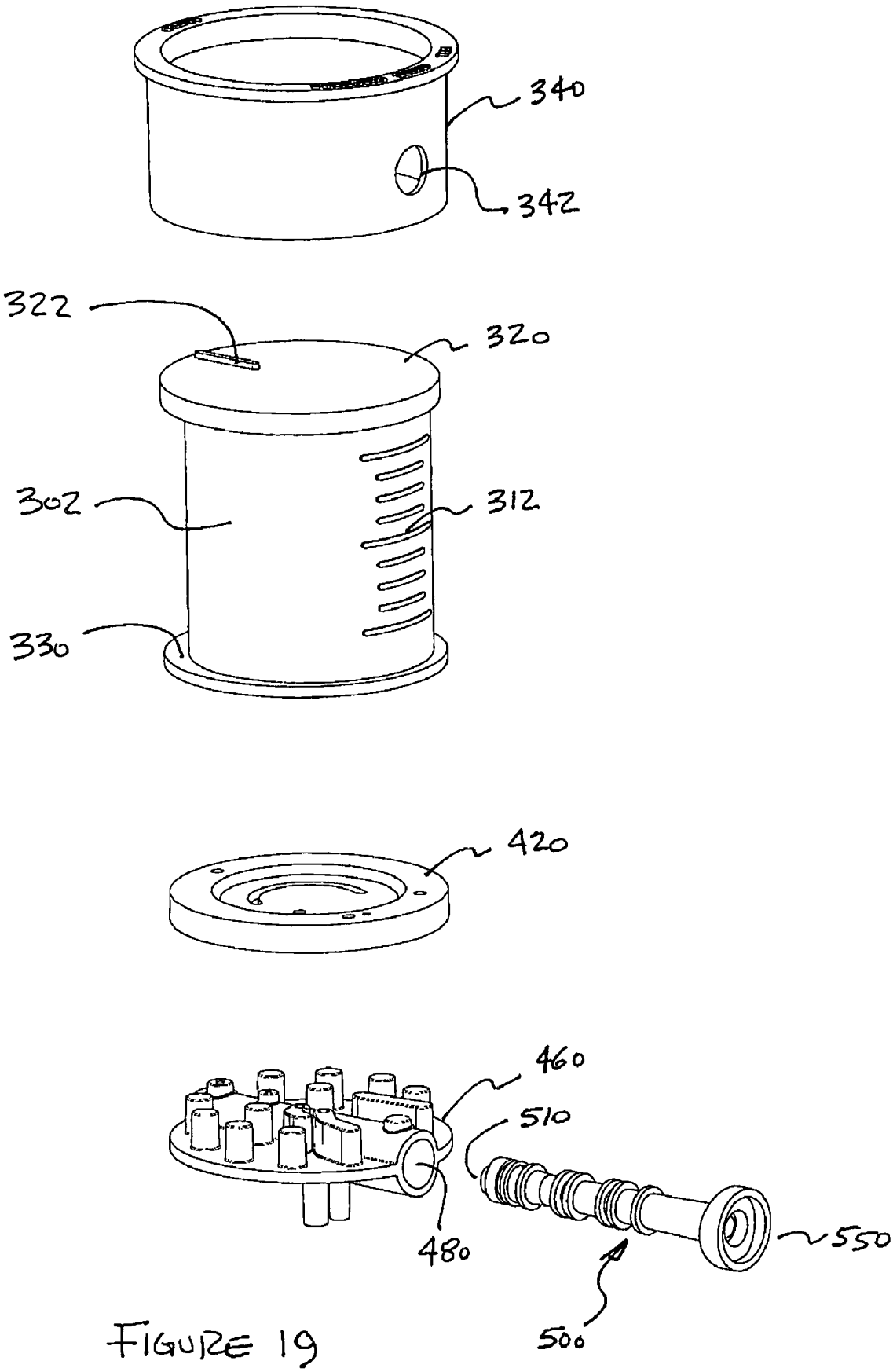
FIG. 19 is an exploded perspective view of the sight glass container and selection control valve sub-assembly, set to the CLEAN setting.
Figure 20:
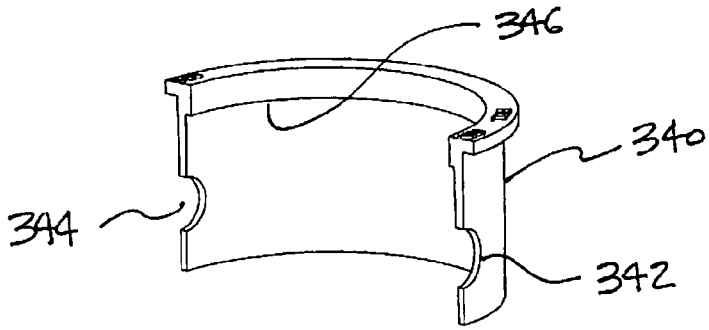
FIG. 20 is an exploded perspective sectional view of the embodiment as shown in FIG. 19.
Figure 20:
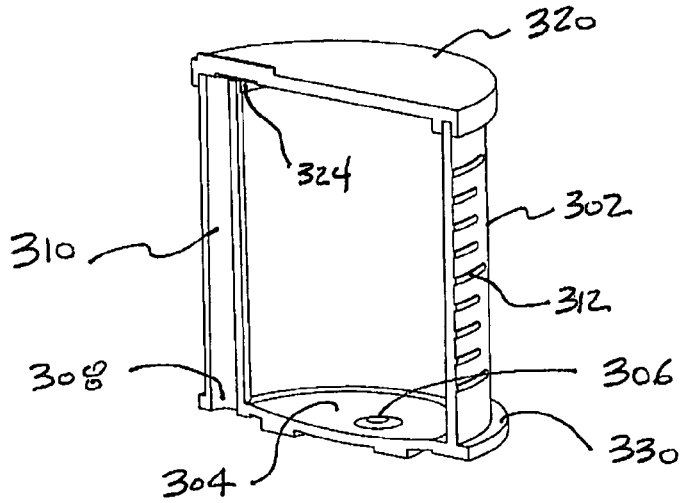
Figure 20:
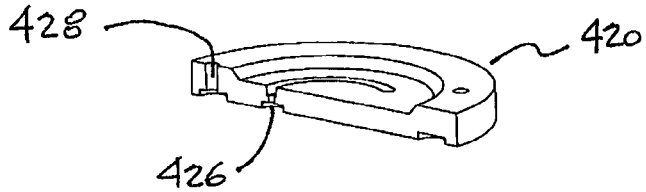
Figure 20:
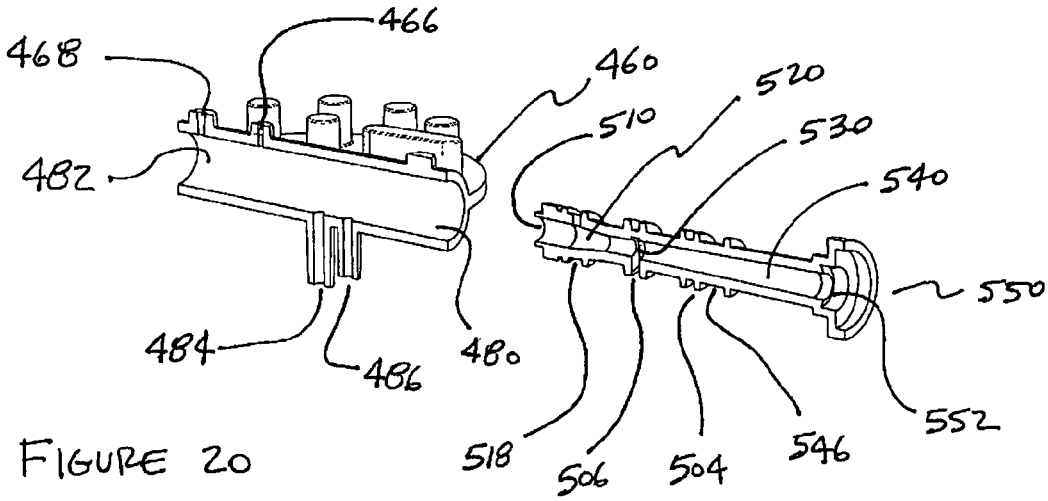
Figure 21:
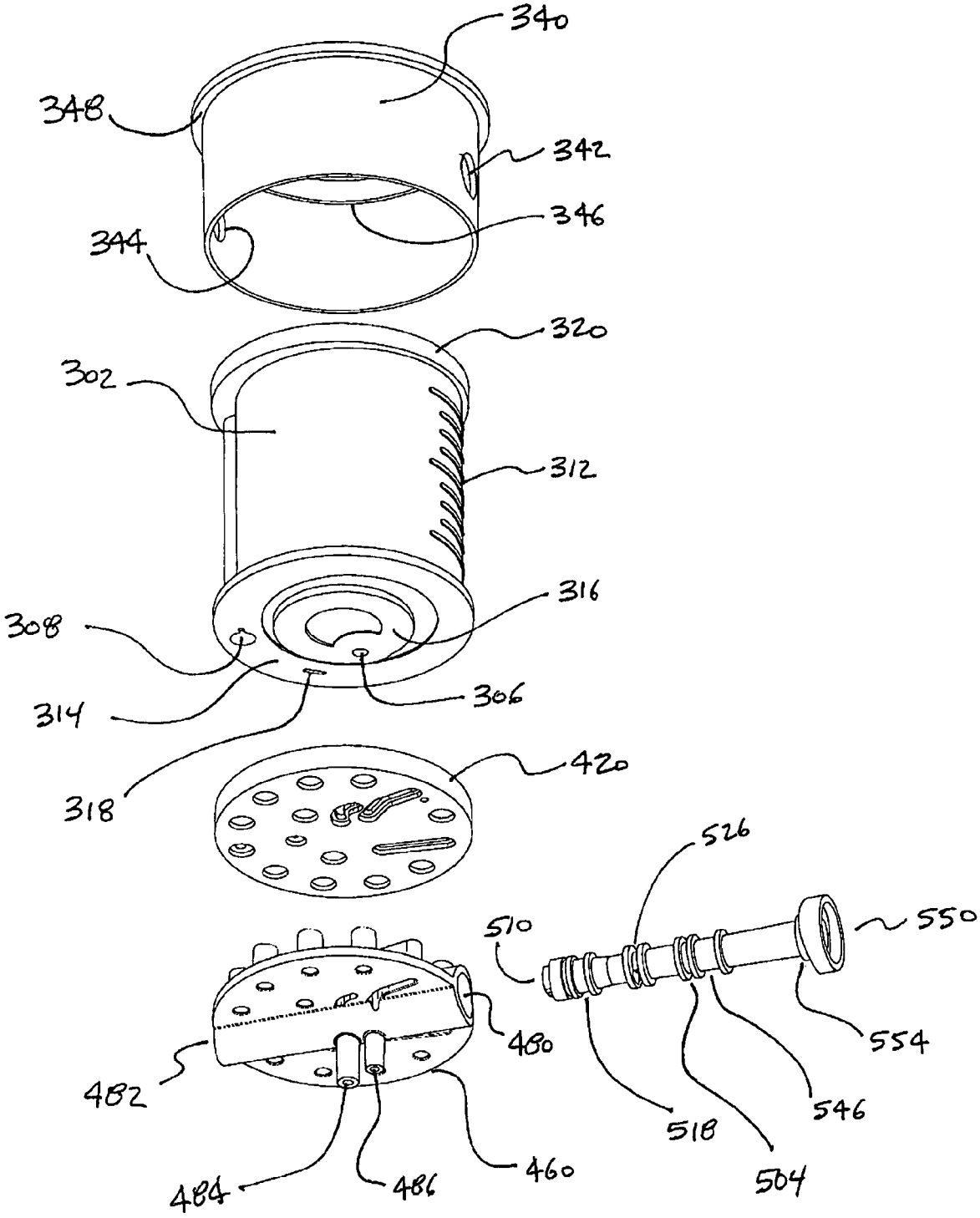
FIG. 21 is an exploded perspective view, from a bottom perspective of the embodiment view as shown in FIG. 19.
Figure 22:
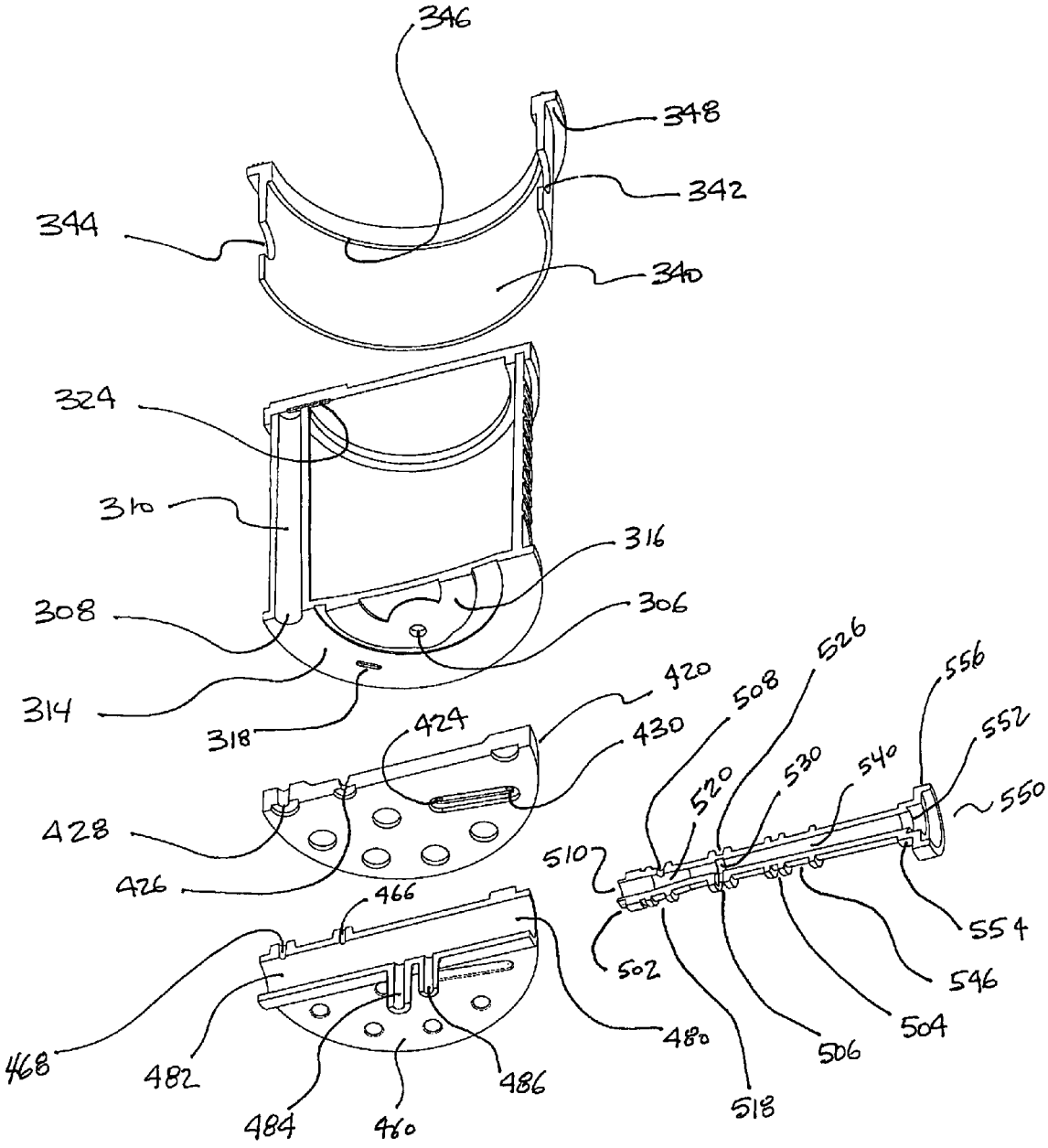
FIG. 22 is an exploded perspective sectional view of the embodiment as shown in FIG. 21.
Figure 23A:
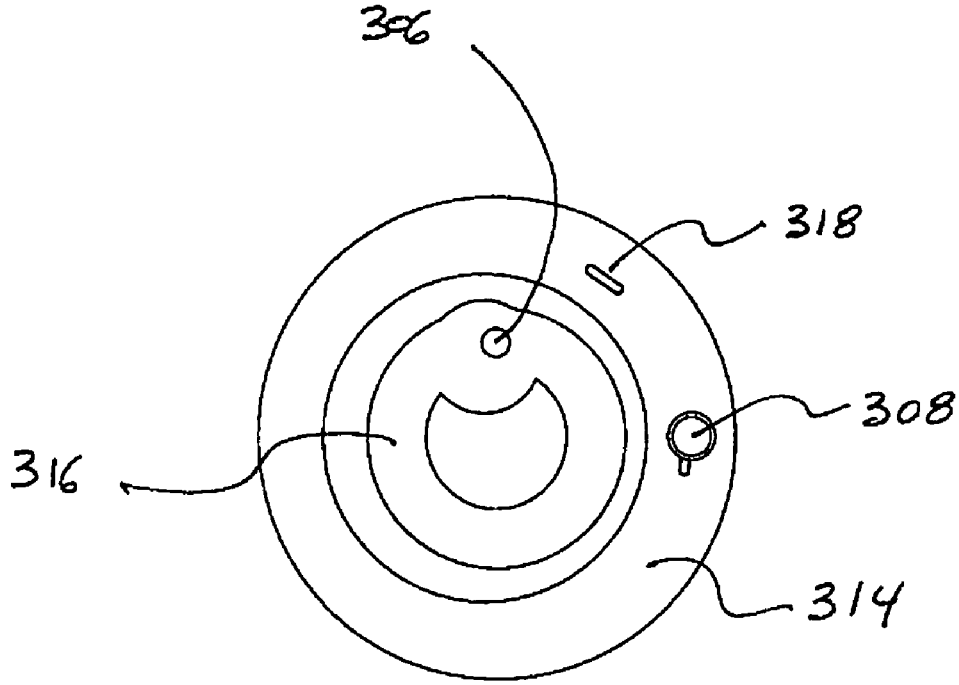
FIG. 23*a* is a bottom view of the sight glass container valve and seal surfaces as illustrated in FIG. 20.
Figure 23B:
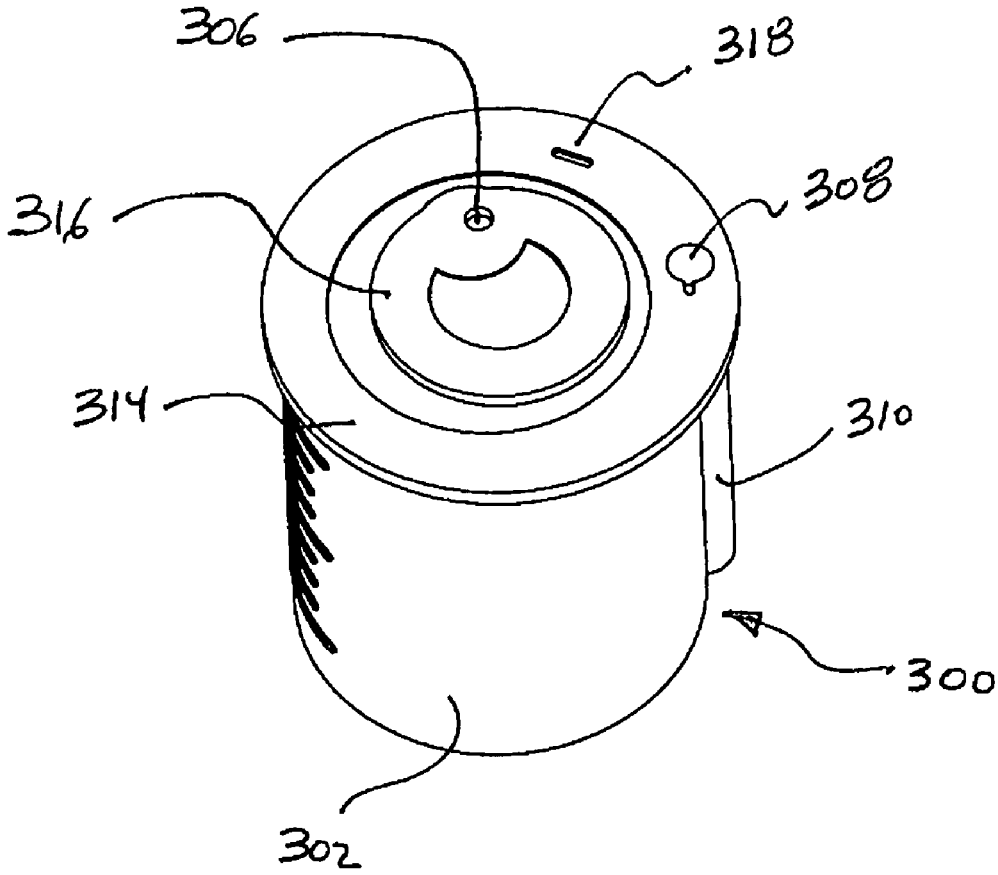
FIG. 23*b* is a perspective view of the embodiment as illustrated in FIG. 23*a;*
Figure 24A:
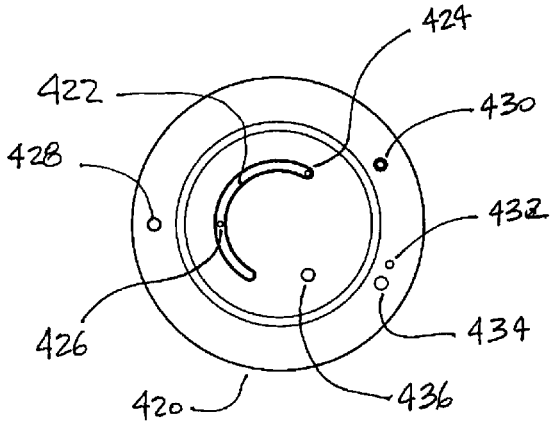
FIG. 24*a* is a top view of the valve plate member as illustrated in FIG. 20.
Figure 24A:
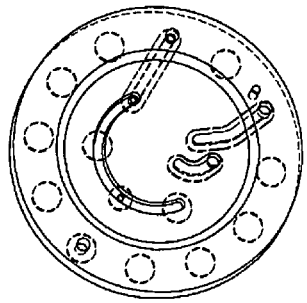
Figure 24B:
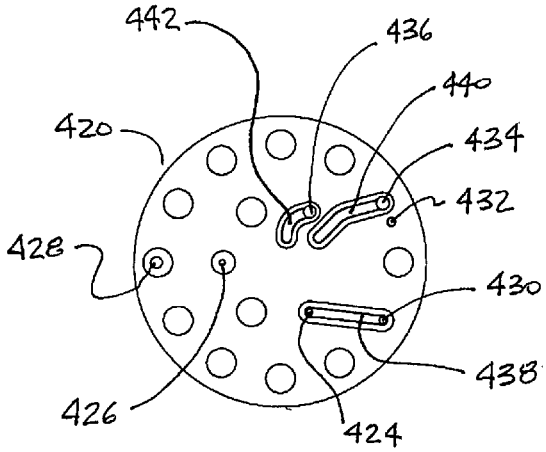
FIG. 24*b* is a bottom view of the valve plate member as illustrated in FIG. 24*a;*
Figure 24C:
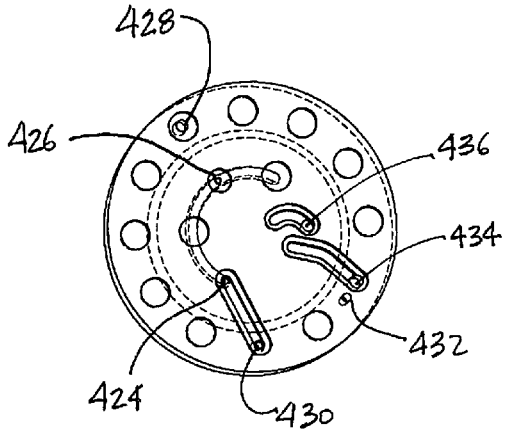
FIG. 24*c* is a slightly rotated perspective view of the valve plate member showing the relationship between the features on the top and the bottom of this part as shown in FIG. 20.
Figure 25A:
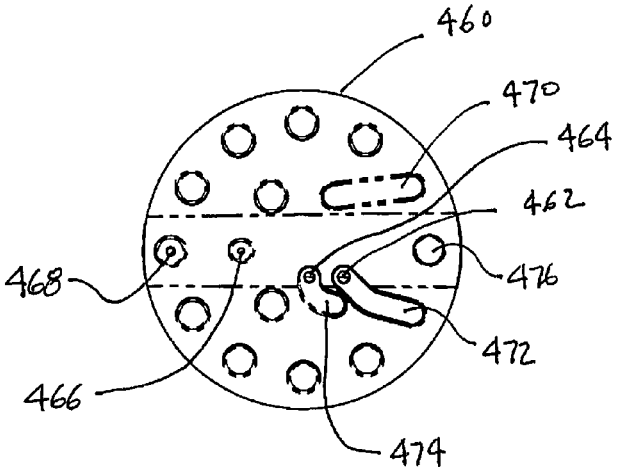
FIG. 25*a* is a top view of the fluid housing member as illustrated in FIG. 20.
Figure 25C:
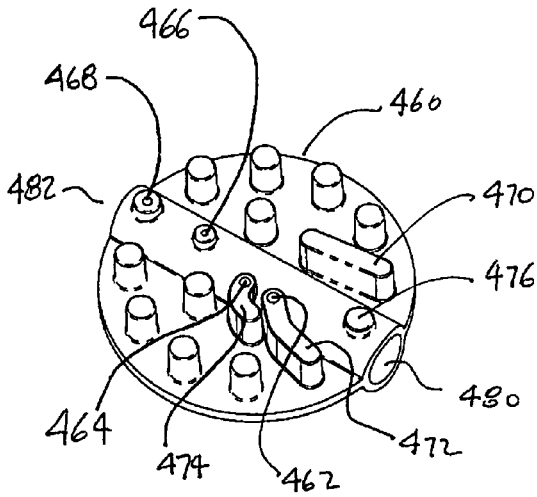
FIG. 25*c* is a slightly rotated perspective view of the fluid housing member showing the relationship between the features on the top and the bottom of this part as shown in FIG. 25*a;*
Figure 25B:
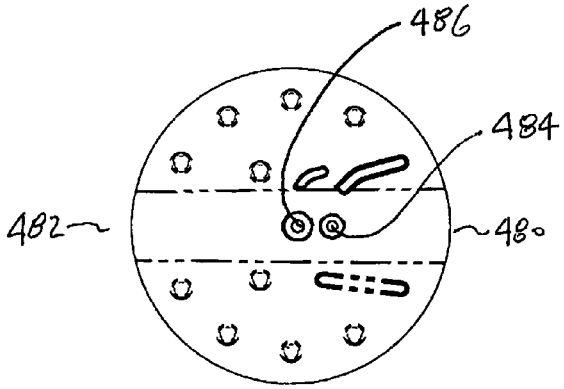
FIG. 25*b* is a bottom view of the fluid housing member as illustrated in FIG. 24*a;*
Figure 25D:
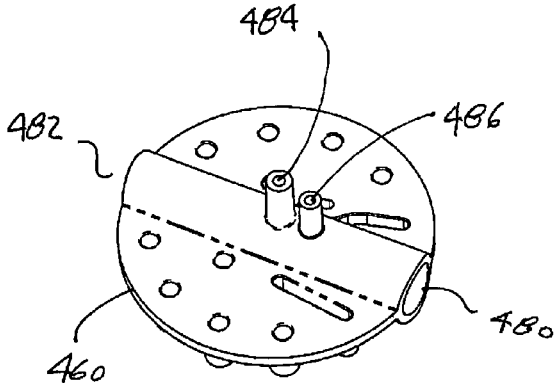
FIG. 25*d* is a slightly rotated perspective view of the fluid housing member showing the relationship between the features on the top and the bottom of this part as shown in FIG. 25*b;*
Figure 26:
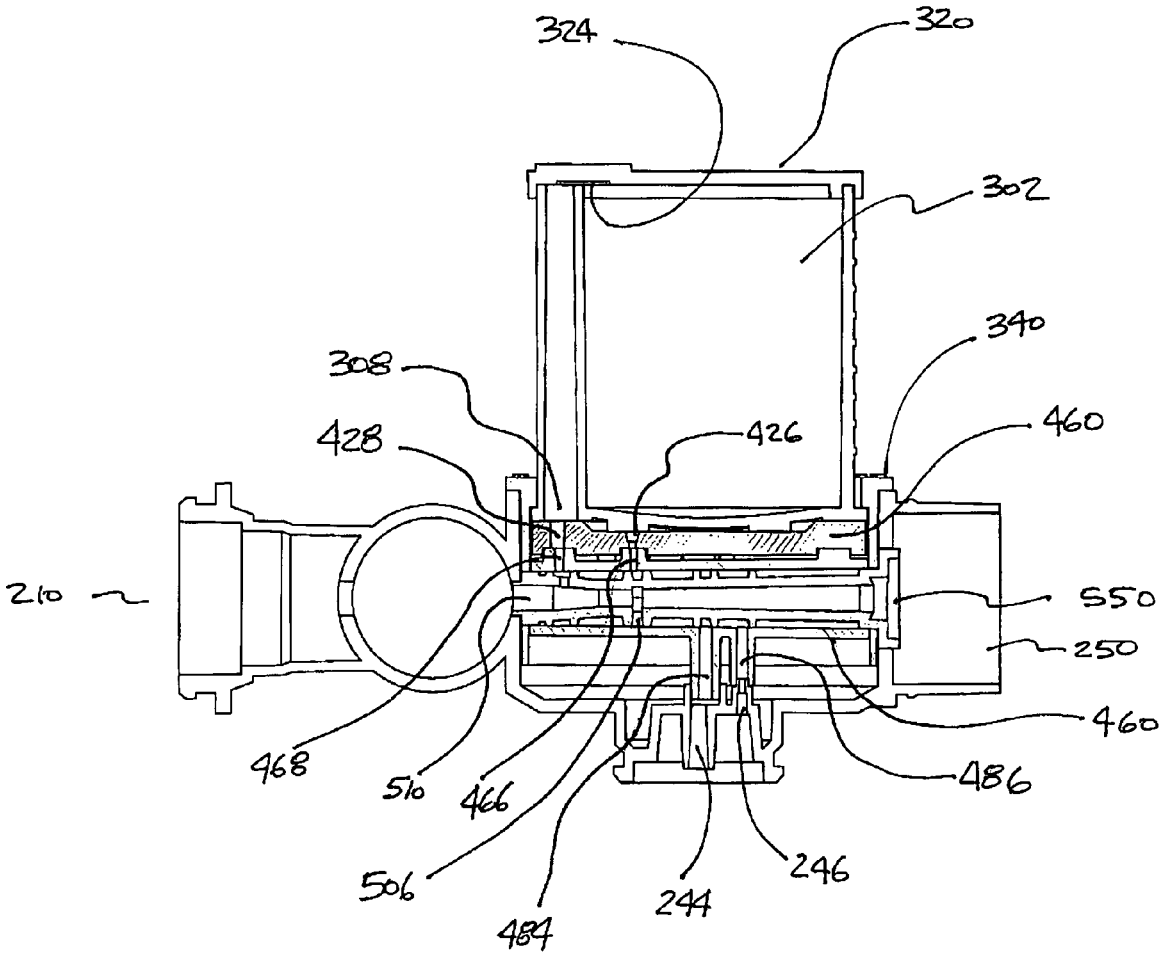
FIG. 26 is a front partial sectional view illustrating just the sight glass container and the selection valve as they are assembled to the housing, corresponding to the embodiment as shown in FIG. 1.
Figure 27:
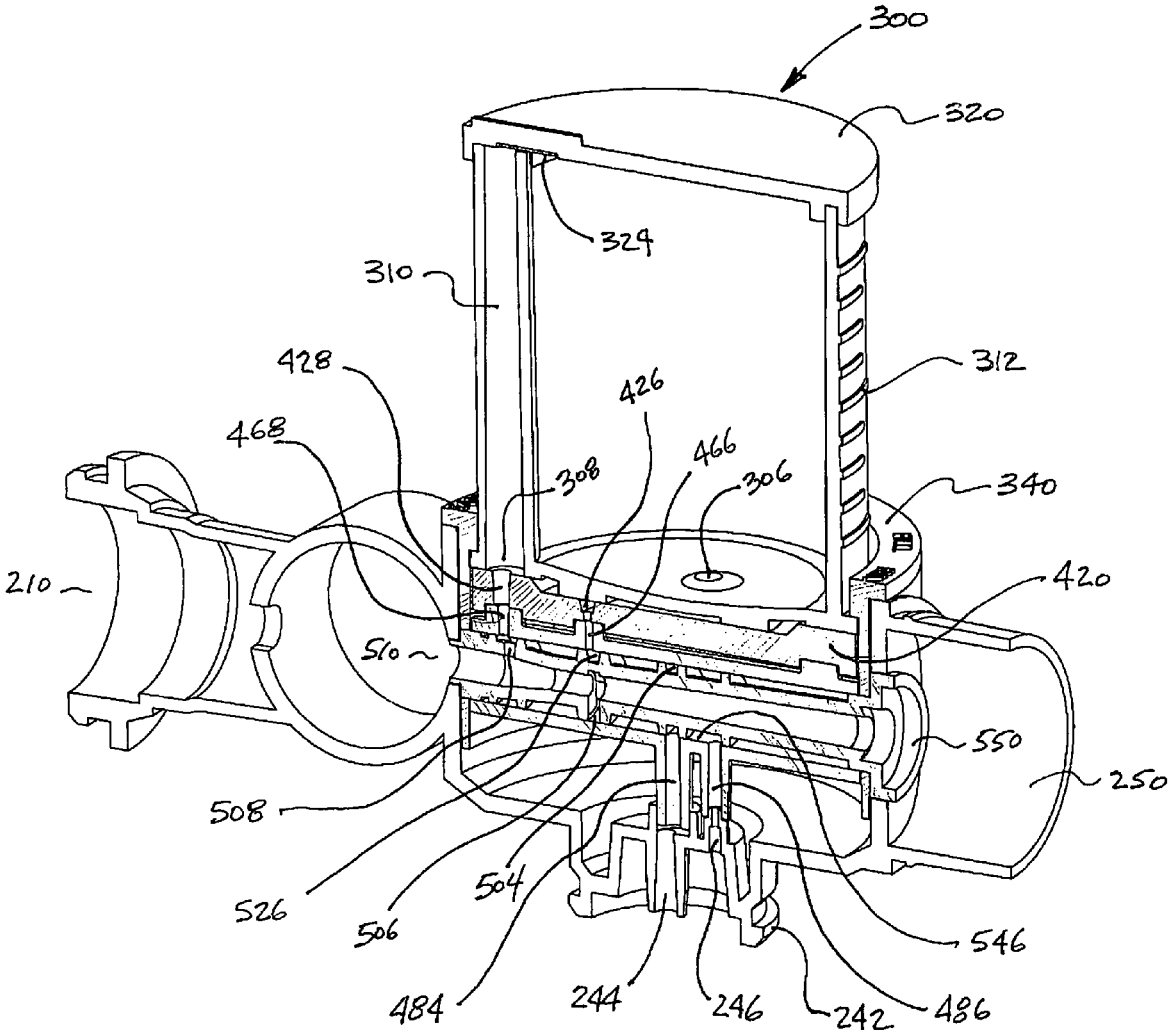
FIG. 27 is a perspective sectional view of the partial embodiment as shown in FIG. 26.
Figure 28B:
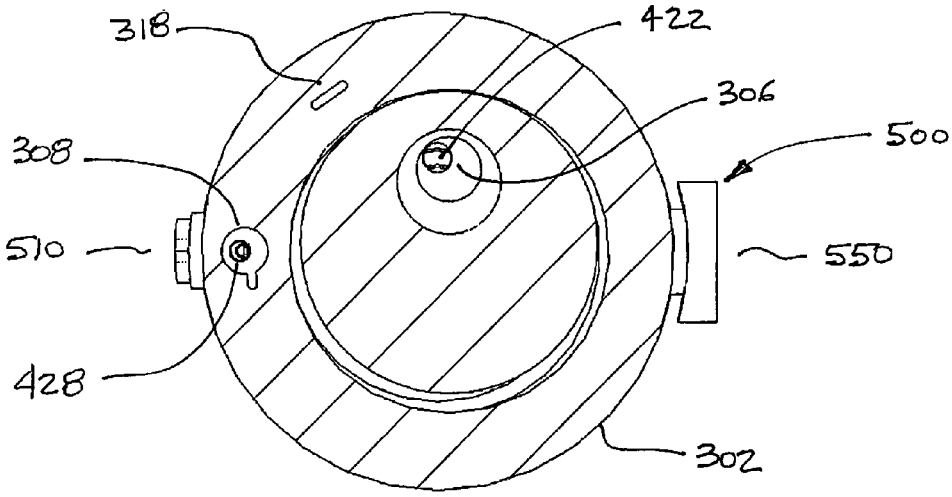
FIG. 28*b* is a section view, taken from FIG. 28*a*, showing the relationship of the valve features on the sight glass bottom surface to the valve features on the valve plate top surface.
Figure 28A:
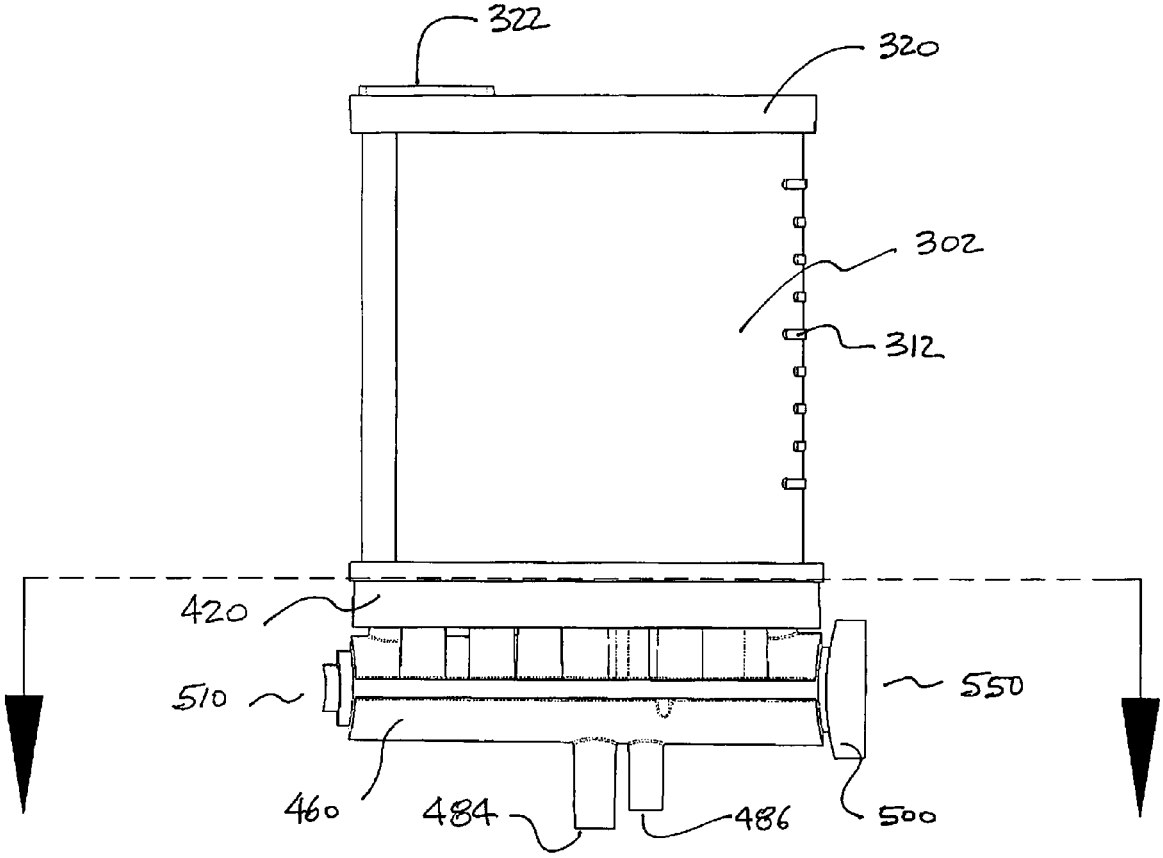
FIG. 28*a* is a partial front view of the sight glass container and selection valve assembly, configured as set to the CLEAN selection.
Figure 29B:
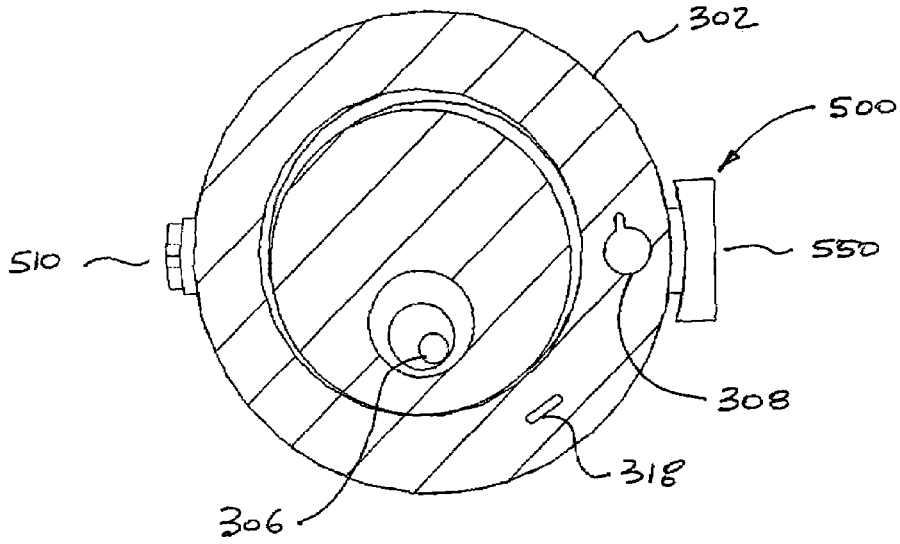
FIG. 29*b* is a section view, taken from FIG. 29*a*, showing the relationship of the valve features on the sight glass bottom surface to the valve features on the valve plate top surface.
Figure 29A:
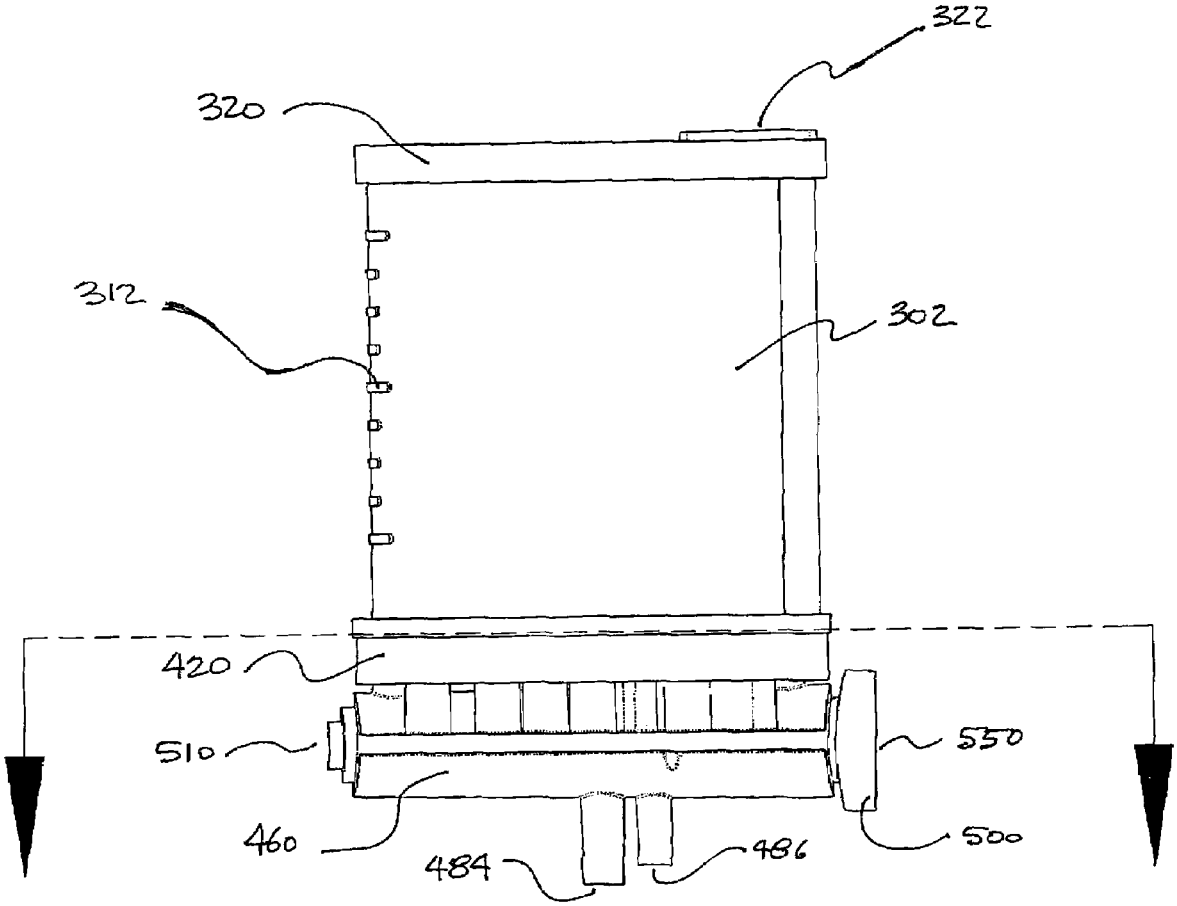
FIG. 29*a* is a partial front view of the sight glass container and selection valve assembly, configured as set to the RINSE selection.
Figure 30B:
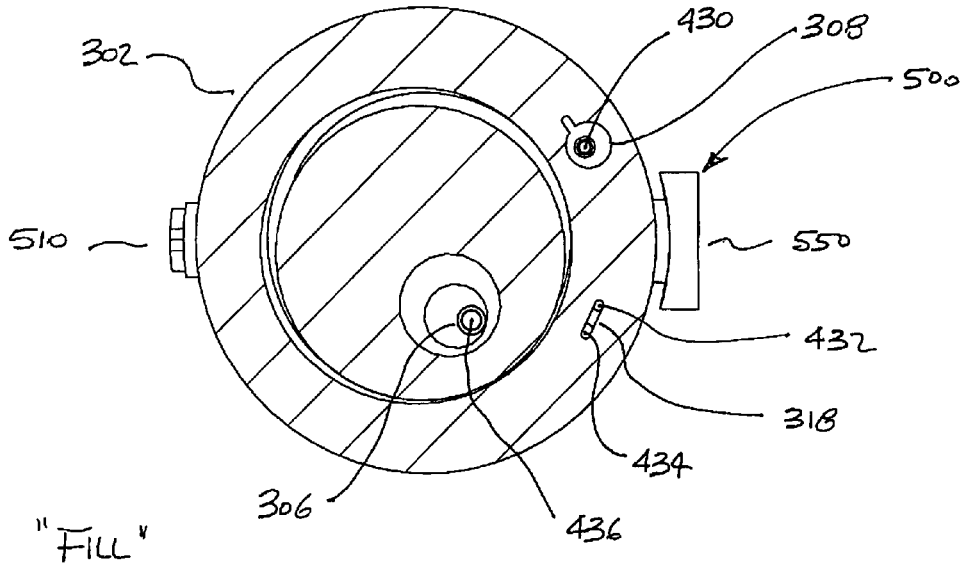
FIG. 30*b* is a section view, taken from FIG. 30*a*, showing the relationship of the valve features on the sight glass bottom surface to the valve features on the valve plate top surface.
Figure 30A:
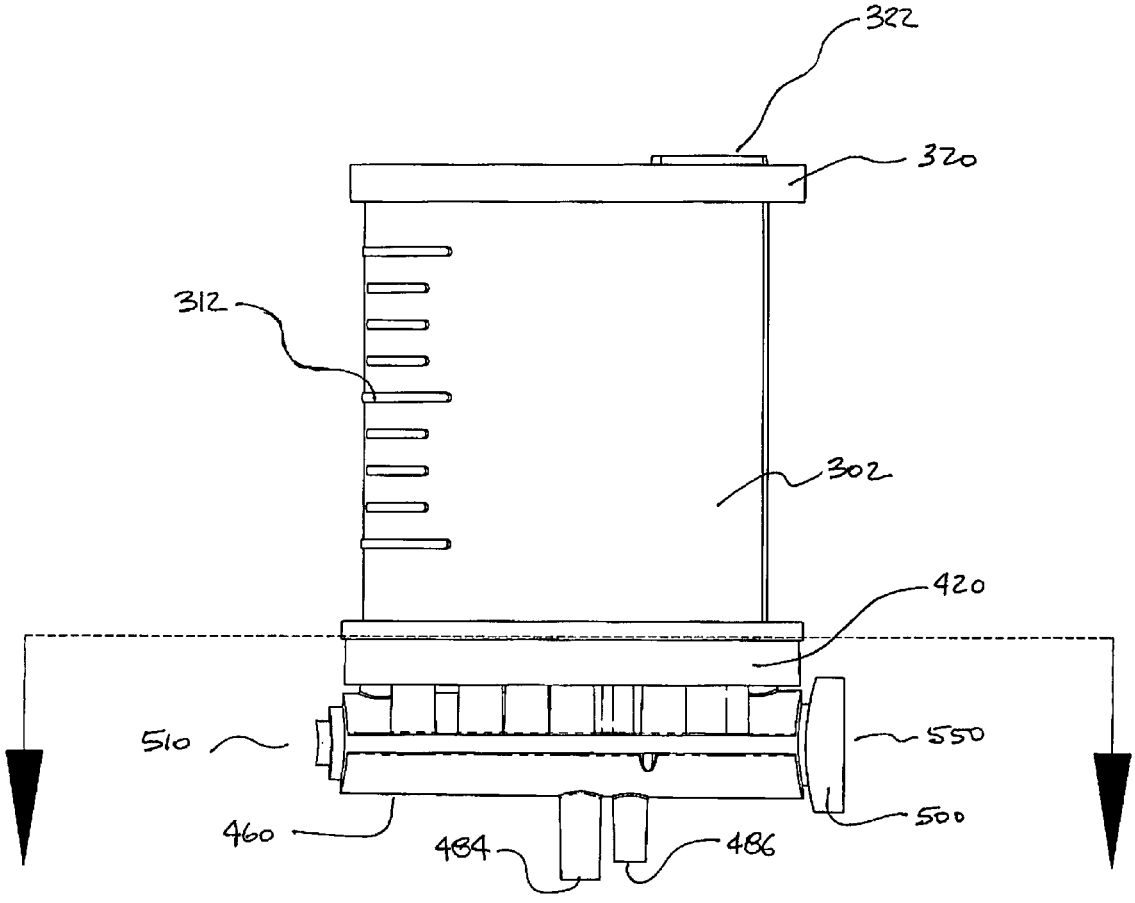
FIG. 30*a* is a partial front view of the sight glass container and selection valve assembly, configured as set to the FILL selection.
Figure 31B:
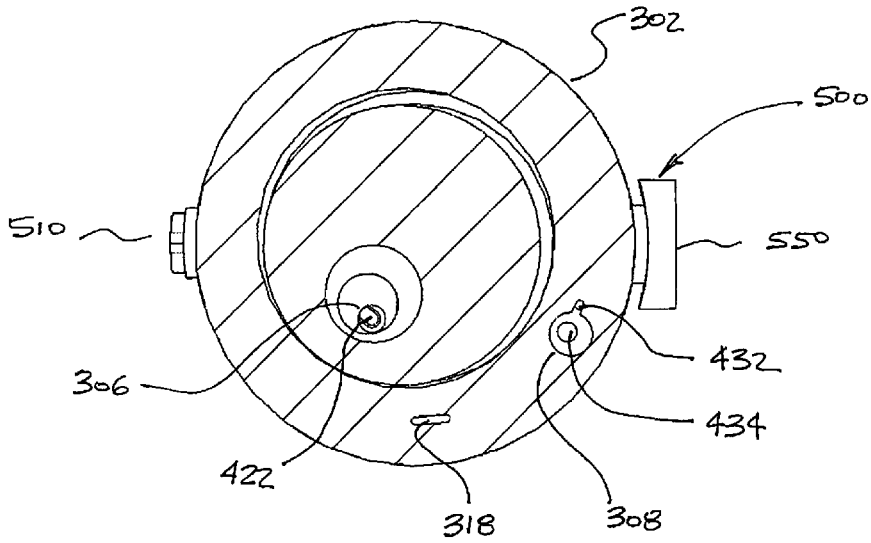
FIG. 31*a* is a partial front view of the sight glass container and selection valve assembly, configured as set to the DISPENSE selection; and, FIG. 31*b* is a section view, taken from FIG. 31*a*, showing the relationship of the valve features on the sight glass bottom surface to the valve features on the valve plate top surface.
Figure 31A:
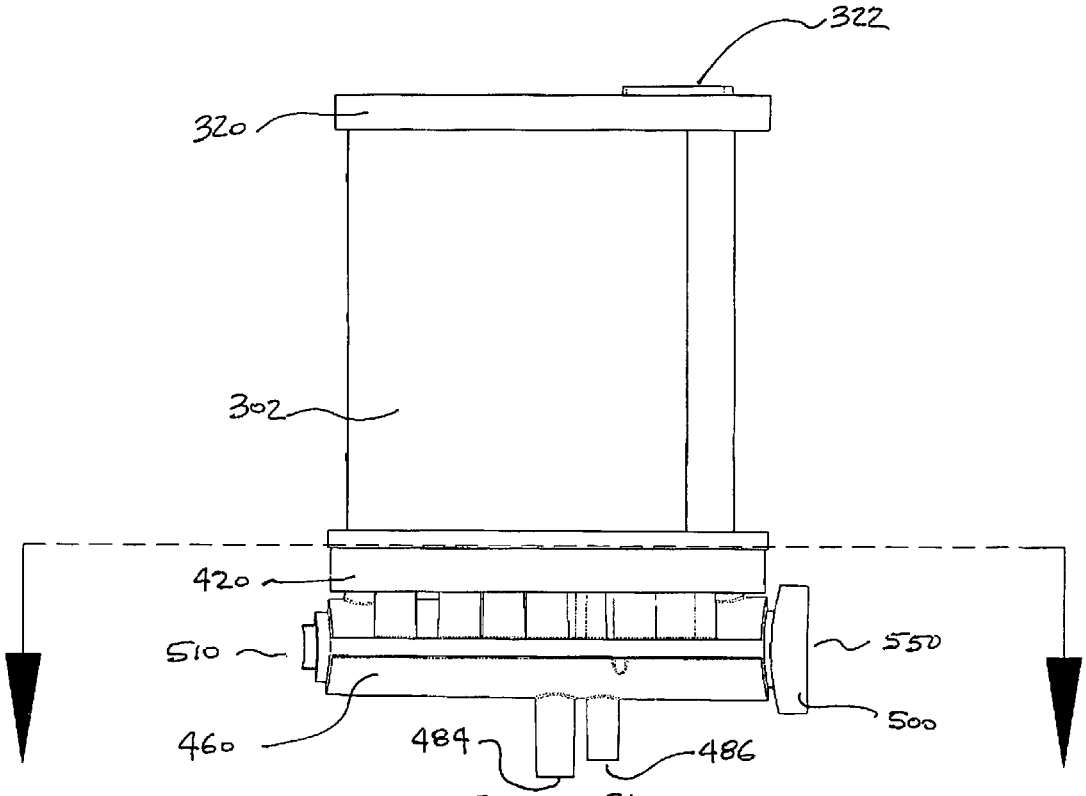

System 1000 provides the user with multiple control means, first a fluid flow control to either allow fluid flow through the device or to prevent or stop fluid flow through the device, and second a rotatable function selection control to allow the user to 1) fill the sight glass container with liquid material from the source container "FILL"; or, 2) flow fluid from the pressurized source fluid only through the device "RINSE", or 3) dispense liquid material from the sight glass container in a diluted form mixed with the fluid from the pressurized source fluid "DISPENSE" and 4) fill the sight glass container with fluid from the pressurized fluid source and simultaneously dispensing from the sight glass container for rinsing or cleaning the sight glass interior after use with the liquid material "CLEAN". FIGS. 1 through 12 show the sight glass rotated to the "CLEAN" position; FIGS. 13 and 14 show the sight glass rotated to the "RINSE" position; FIGS. 15 and 16 show the sight glass rotated to the "FILL" position; and, FIGS. 17 and 18 show the sight glass rotated to the "DISPENSE" position.

System 1000 includes fluid flow control valve 80 and an internal function selection valve mechanism 400, both disposed within the housing's intermediate portions 220 and 230 respectively. In the exemplary embodiment shown, the flow control valve 80 serves the general function of selectively admitting or blocking a pressurized fluid stream received through the inlet 210 in accordance with one of numerous configurations. The internal function selection valve mechanism 400 is coupled to and actuated by sight glass container 300. A venturi tube component 500 is positioned within the internal function selection valve 400 such that the low pressure condition (vacuum) generated at the venturi can be placed in fluid communication with functional ports as needed by the selection valve to provide the function selected. Hence, upon selection by the user via rotation of the sight glass container 300, the internal function selection valve mechanism 400 provides selective communication with the low pressure (vacuum) condition, generated by the flow of fluid through the venturi tube 500 to the port(s) selected and simultaneously directs the flow of liquid material acted upon by the vacuum to the selected port(s) within the internal function selection valve 400. In some selected instances the internal function selection valve 400 will also direct a portion of the pressurized fluid within venturi tube 500 through selected ports to provide a cleaning function for rinsing the interior of the sight glass container 300.

Figure 9:
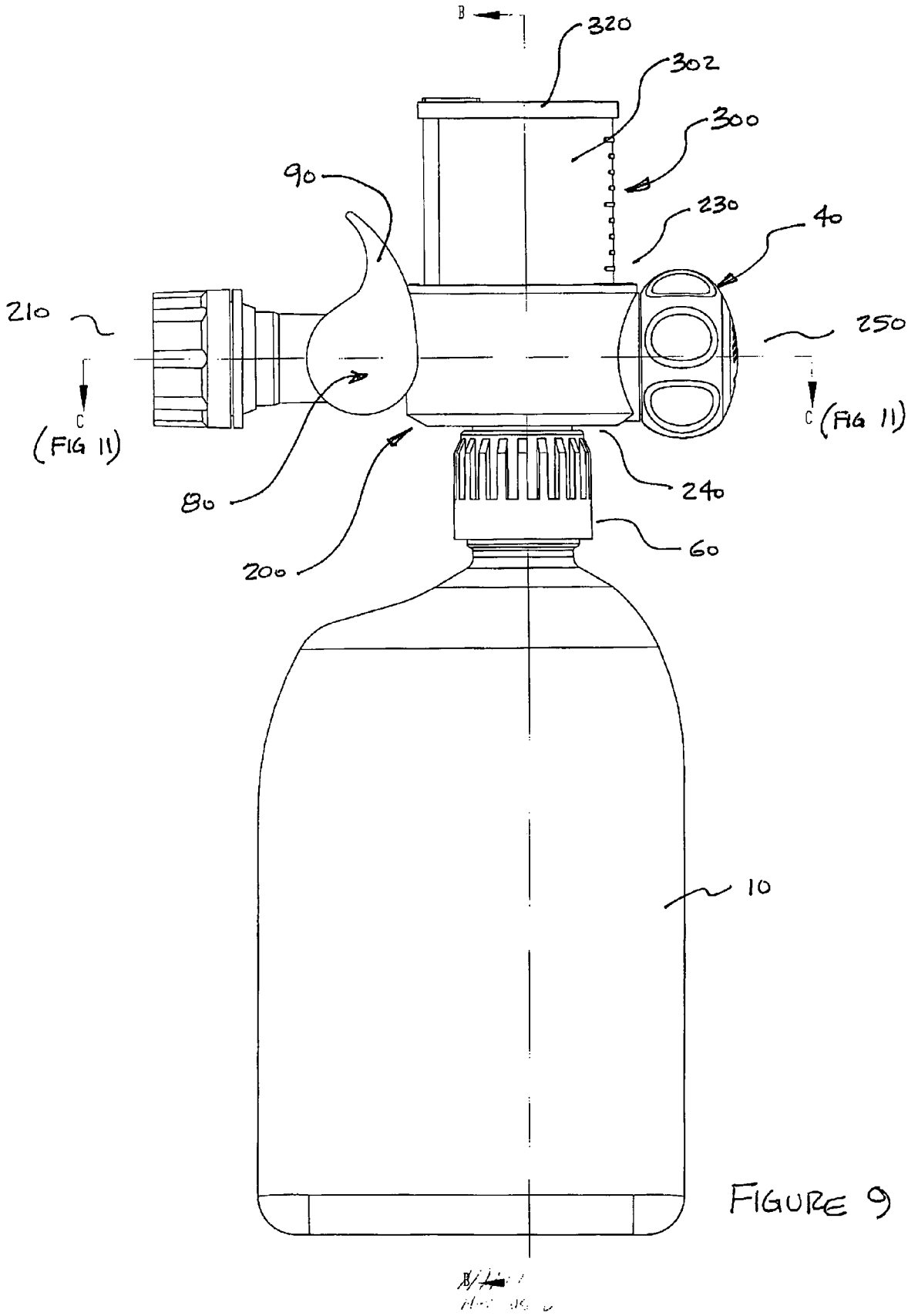
FIG. 9 is a front view corresponding to the embodiments as illustrated in FIG. 5, except the flow control valve is shown in the ON or flow enabled condition.
Figure 10:
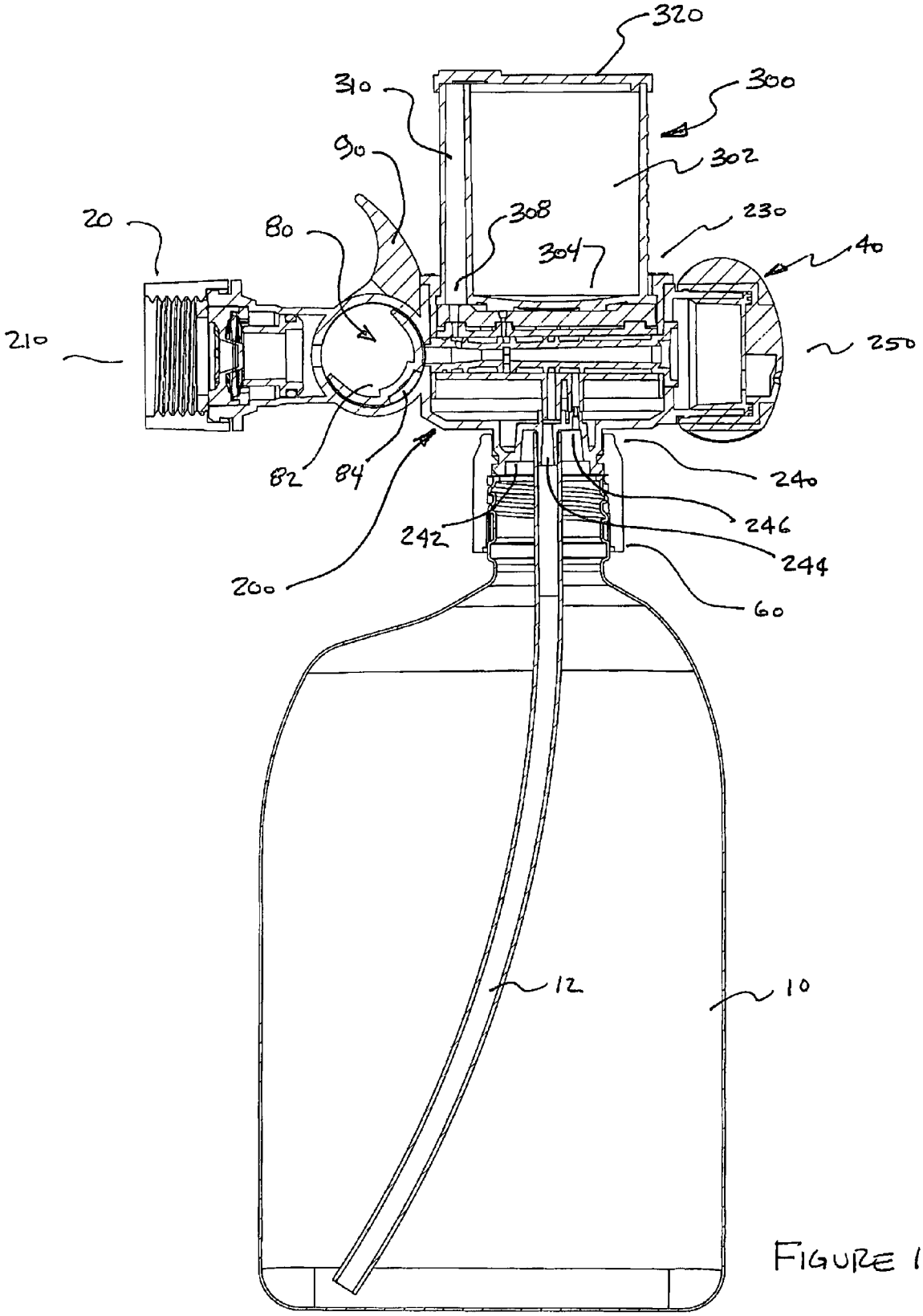
FIG. 10 is a front sectional view corresponding to the embodiments as illustrated in FIG. 9.
Figure 11:
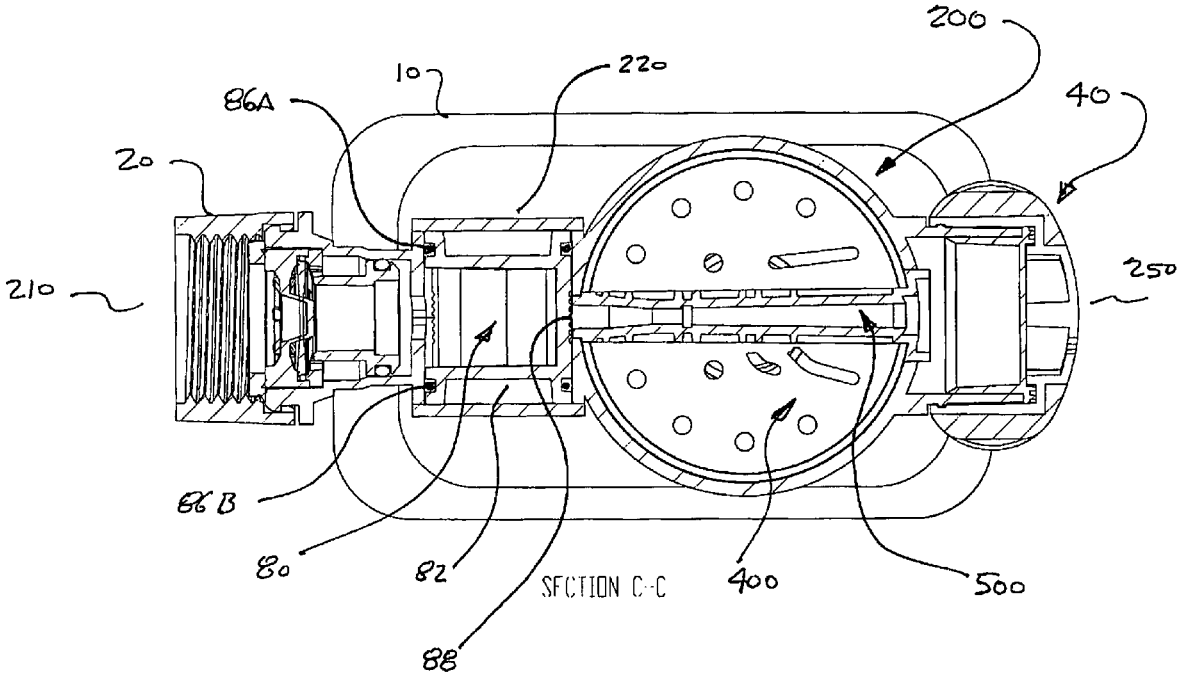
FIG. 11 is a horizontal cross sectional view corresponding to the embodiment as illustrated in FIG. 9.
Figure 12A:
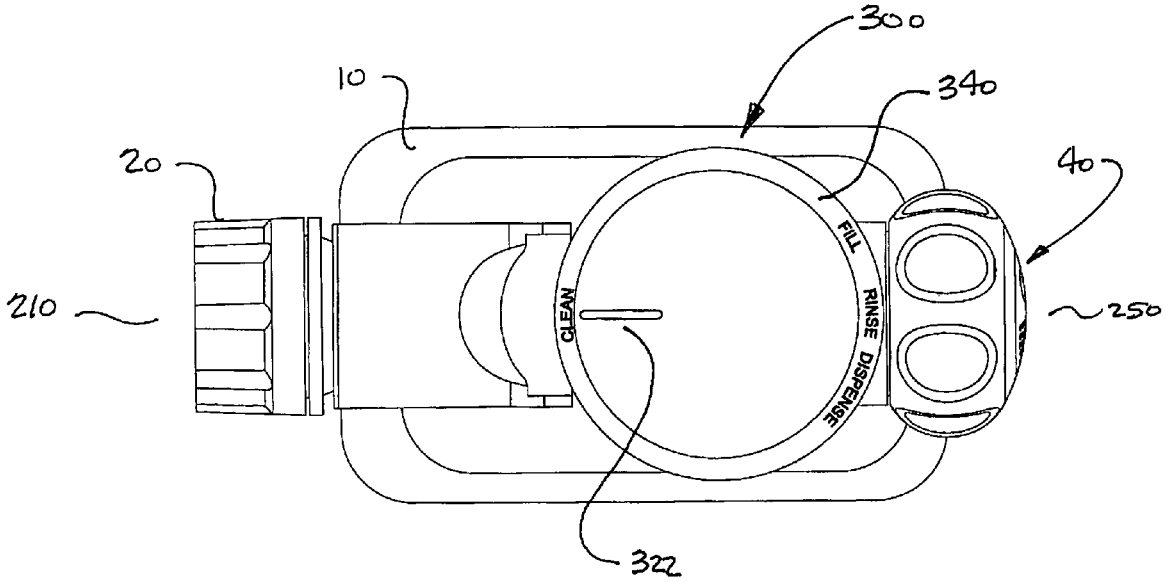
FIG. 12*a* is a top view of the embodiment as shown in FIG. 1, as set to the CLEAN setting.
Figure 12B:
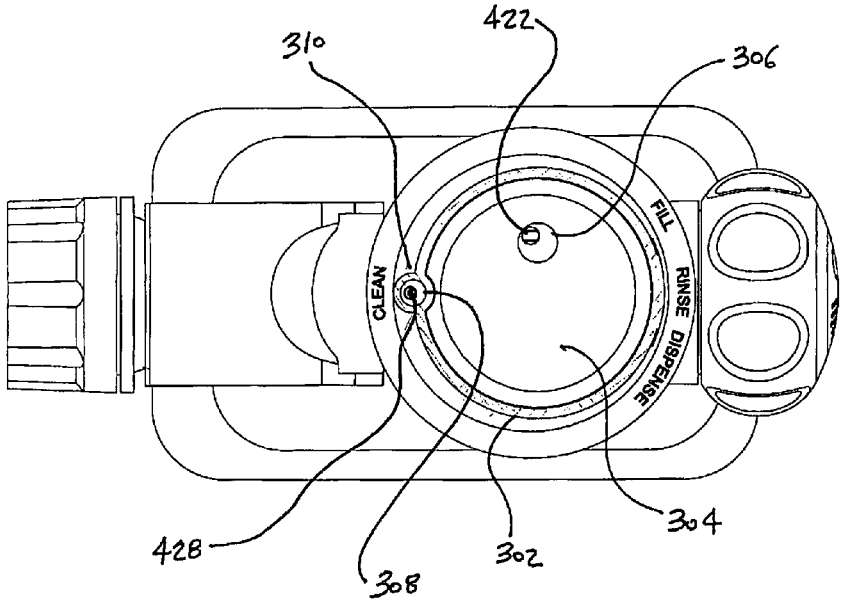
FIG. 12*b* is a top sectional view of the embodiment as shown in FIG. 12*a*, highlighting the alignment of the flow ports relative to the selection indicia.

Flow control valve 80 comprises a rotatable drum element 82 disposed within housing section 220, a resilient face seal member 84 and two o-ring seals 86*a* and 86*b* disposed at either end of the drum element 82 to contain the pressurized fluid in all operating conditions. Handle member 90 is connected to rotating drum element 82 to transmit torque as force is applied to handle 90 by the user in either direction. Suitable end of stroke stop features are used to provide a high force feedback to the user so they know that the handle has traveled to the correct and final position. FIGS. 1 through 8 all show this flow control valve in the closed, or blocking flow position; FIGS. 9, 10 and 11 all show the flow control valve in the open or permitting flow position. Grooves 88 positioned on the outer periphery of rotatable drum element 82 permit the flow of pressurized fluid around the drum perimeter and into the receiving end 510 of the venturi tube 500. These grooves 88 can be configured with the correct cross-sectional area required to permit a desired rate of flow of the pressurized fluid.

Referring to FIGS. 12 through 23, the sight glass container 300 includes a substantially cylindrical clear main housing 302 with an integrally formed bottom 304 through which there is at least one access port 306 for communication with the selection valve portion 400. The top of the sight glass container is closed by a lid member 320 permanently affixed to the sight glass housing 302 providing a pressure tight seal. A conduit member 310 is integrally formed as part of the sight glass housing 302 and is situated to run between the sealed underside of the top member 320 and the selection valve portion 400 located just beneath the formed bottom 304 of the sight glass housing 302. This conduit 310 provides fluid communication between the selection valve portion 400 and the interior chamber of the sight glass container via the top inside surface of the sight glass container. The exterior surface of this sight glass container has formed or printed on it graduation lines 312 indicating the volume inside the container at each line. These graduations are provided to give volumetric feedback to the user during filling and dispensing operations. The lid member 320 has formed or printed on it an indicator 322 showing the user which selection is selected. The underside of the lid member 320 has a recessed area 324 adjacent to the conduit feature 310 to allow fluid communication between the interior of the sight glass container 300 and the conduit 310. In certain embodiments a float style check valve might be used to guard against overfilling the sight glass container with liquid material from the source container. This float style check and shut-off valve is a common device and is known in the art, hence it is not discussed in further detail herein. This sight glass container, formed bottom, lid and conduit are each preferably formed of a rigid clear plastic material, such that they exhibit the strength required for the internal fluid pressures encountered, they are chemically compatible with the fluids and liquid materials to be diluted and dispensed, and such that the user can clearly see the contents within the sight glass container.

Preferably located beneath the sight glass container 300 and coupled to the body 200 by the assembly of the venturi tube 500 through the sight glass retainer 340 is the selection valve portion 400. Referring to FIGS. 19 through 27, this valve assembly preferably includes several main parts. In order, from the top working downward in the illustration embodiment, the bottom surface of the sight glass container forms the first layer of the valve assembly, the valve plate 420 is next, its top surfaces mating and sealing with the bottom surfaces of the sight glass container 314 and 316 respectively. The fluid housing 460 is next, situated beneath the valve plate 420 and providing a pressure tight seal with features on the bottom surface of valve plate 420, specifically features 466, 468, 470, 472 and 474 situated on the top surface of fluid housing 460 all mate with and provide a pressure tight seal to corresponding features on the bottom surface of the valve plate 420. A transverse cylindrical feature 480 to 482 is disposed between the top and bottom surfaces of fluid housing 460 to receive the venturi tube 500. The bottom surfaces of fluid housing 460 are situated to fit and mate in a sealed manner with features within the lower portion 240 of the housing 200. Conduits 484 and 486 on the fluid housing mate and seal with ports 244 and 246 as part of housing portion 240 for the conveyance of the liquid material and for venting of the container when required as per the selection of the user. Venturi tube 500 is situated concentric to the transverse feature on the fluid housing 460. External features on the venturi tube 500 form sealed chambers 518, 526, 504 and 546 around the venturi tube 500 and within the fluid housing 460. The interior of the venturi tube is shaped to provide the velocity profile required to achieve the lower than atmospheric pressure condition desired. Fluid from the pressurized source, typically water, enters the venturi tube at portion 510 upon exiting the flow control valve 80, the fluid stream is then constricted through section 520 causing a corresponding increase in the fluid velocity, thereby dropping the stream pressure, the fluid then exits the constricted zone and enters a larger cross-sectional area 530 whereupon the fluid pressure is well below atmospheric pressure, it is here that port 506 to place this low pressure condition is fluid communication with the valve portion 400 through the annular chamber 526 around the exterior of the venturi tube, passing further downstream from the venturi the fluid enters the slightly diverging area 540 where the fluid makes intimate contact with the inner walls to seal off the venturi section 530 from the atmosphere downstream and the fluid stream finally exits the venturi at portion 550 and enters the nozzle area. The exit from the venturi tube is kept free of flow disturbances by the clean and smooth surfaces throughout the flow path from 510 to 550, at the exit a feature 552 is arranged to allow a clean fluid transition and to prevent fluid spray or atomization at the exit transition. In the assembly of the valve portion 400 and the sight glass container 300 to the housing 200, venturi tube 500 provides the fastening means. The sight glass retainer 340 is telescopically slid over the sight glass container 300 and the selection valve portion 400 and then into the housing portion 230; once seated in the housing the venturi tube 500 is inserted from the nozzle end of the housing 250 and is telescopically slid into the bore on the fluid housing until end feature 502 engages through sight glass retainer bore 344 and into the housing bore 224 as a press fit, simultaneously cylindrical feature 554 on the venturi tube enters the sight glass retainer 340 at bore 342 and cylindrical feature 556 press fits into housing bore 252 to lock the venturi tube 500 into housing 200 and likewise affix the selection valve portion 400, sight glass container 300 and the sight glass retainer 340 into the housing 200. Sight glass container 300 is free to rotate within the sight glass retainer 340 however valve plate 320 is fixed to non-rotating fluid housing 360. Flange member 330 on the sight glass container 300 rides under flange step 346 on the sight glass retainer 340 piece applying enough force to help the bottom surfaces 314 and 316 of sight glass container 300 to seal against the corresponding top surfaces of the valve plate 420. In practice, valve plate 420 may be manufactured from a material slightly less hard than the corresponding rotating and mating surfaces 314 and 316, so that the face seal is maintained. Likewise, producing the valve plate from a softer material will facilitate the press fit seals to the fluid housing 460 at the manifold features 438, 440 and 442.

In operation low pressure (vacuum) is generated at the venturi throat 530, which is in fluid communication through port 506 with chamber 526, which is in fluid communication through port 466 and 426 with manifold feature 422. Manifold feature 422 then normally remains at the same pressure state as the venturi throat portion 530, that is, at atmospheric pressure when there is no fluid flowing and at lower than atmospheric (or vacuum) when fluid is flowing. Manifold feature 422 also is in fluid communication through port 424 into manifold feature 438 and to port 430.

In operation, fluid pressure from the pressurized stream, and because of the constriction in portion 520 of the venturi tube 500, cause pressurized fluid to flow through port 508 and into the annular chamber 518 which is in fluid communication with ports 468 and 428. Hence, port 428 remains at the same pressure state as portion 520 in the venturi manifold, as atmospheric pressure when no fluid is flowing and at a pressure near to the fluid stream pressure at 520 when fluid is flowing.

The liquid material in the source container 10 is available for filling the sight glass container 300 through the suction tube 12 connected to port 244 on the housing which is in sealed fluid communication through port 484 and annular chamber 504 and through port 464 and manifold feature 442 supplying port 436. Hence when selected and vacuum is available in the sight glass container 300, liquid material can flow from the source container through the suction tube 12 through ports 244 and 484 into annular chamber 504 and through port 464 into manifold feature 442 and through port 436 into the sight glass container 300. Simultaneously, atmospheric air can enter the source container to provide the pressure required to cause the flow of the liquid material, and vent port 246 is in fluid communication through port 486 and annular chamber 546 into port 462 to manifold feature 440 connecting to port 434. Port 432 provides a path to the atmosphere and, when selected, port 432 is connected to port 434 by means of features 318 and 308 on the sight glass container bottom surface 314. Hence, when selected, port 432 provides a path to vent the container 10 to atmosphere.

In summary, when CLEAN is selected and fluid is flowing, port 508 supplies pressurized fluid through annular chamber 518, port 468 and 428 into portion 308 and through conduit 310 into the sight glass container, while simultaneously port 306 is aligned with manifold feature 422 which is at a lower than atmospheric pressure state and the fluid entering the sight glass container is then suctioned out of port 306 through manifold 422, port 426, into annular chamber 526, through port 506 and introduced into the fluid stream at portion 530 of the venturi tube 500, whereby it travels with the fluid stream through the venturi tube, into the nozzle portion 40 and is expelled onto the surface to be treated.

In summary, when RINSE is selected and fluid is flowing, ports 306 and 308 are blocked by the valve plate 420 allowing no flow into or out of the sight glass container 300. Fluid flowing through venturi tube 500 produces the lower than atmospheric pressure condition which is not used since the flow ports are all blocked.

In summary, when FILL is selected and fluid is flowing, port 430 is aligned with portion 308 of conduit 310 allowing vacuum to act on the interior of the sigh glass container, and port 306 is aligned with port 436 providing fluid communication with the source container 10, simultaneously feature 318 provides fluid communication between port 434 and atmospheric vent port 432, thereby providing atmospheric venting to the source container holding the liquid material. Given atmospheric pressure available within the source container 10 and given vacuum condition in the sight glass container 300, liquid material then flows from the source container into the sight glass container.

In summary, when DISPENSE is selected and fluid is flowing, port 306 is aligned with manifold feature 422 providing suction and a flow path to the venturi tube port 506, wherein the liquid material within the sight glass container 300 can be introduced into the flowing fluid stream mixed and dispensed through the nozzle portion 40 and onto the surfaces to be treated. Ports 426 or 466 may be used as a throttle by choosing a port diameter to restrict the flow of the liquid material prior to being introduced into the flowing fluid stream at the venturi portion 530; the choice of a throttle diameter for either port 426 or 466 in relation to the rate of fluid flow through the constricted portion of the venturi tube 520 determines the dilution ratio of the liquid material into the fluid. This ratio may be set by design to allow the user enough time to dispense the required portion of the liquid material onto the desired surface area to be treated.

The housing 200 and other main structural parts including the sight glass container 300, the container connector 60 and the hose connector 20 are preferably formed of hard plastic or other suitable material known in the art of sufficient strength, rigidity, and durability to withstand the conditions typically encountered in the intended application. In applications posing particularly harsh conditions, considerations such as anti-corrosion, thermal expansion, and the like may be significant factors determining the choice of materials for various portions of system 1000. The present invention is not limited to a particular choice of materials; as such choice will depend on the particular requirements of the intended application.

Turning now more closely to the structure for coupling a container or other source of the liquid material (highly concentrated lawn treatment chemical, for instance), a suction tubing 12 positioned with an upper end engaging a nipple 244 and a lower end extending to the bottom of the given container (not shown). If the container is of the type having a threaded opening, it may be threadedly engaged with the adapter 60 for suspension therefrom. Within the adapter 60, a seal 62 such as a flattened O-ring or washer is preferably provided at the sprayer-container interface to prevent air and liquid material leakage. Other attachments such as snap-on, lock-in-key, dovetail, or other such coupling mechanisms known in the art may be alternatively employed.

Various alternative embodiments may be realized in accordance with the present invention. In certain alternative embodiments, for example, the spray nozzle 40 may be replaced by another downstream flow control valve device such as an extension wand or other fluid-conducting attachment coupled to the outlet 250. In certain other exemplary embodiments, an optional detent ball mechanism or other such retaining device may be incorporated in the selection control valve 400, as actuated by sight glass container 300 to give tactile feedback when the sight glass container is optimally positioned for a particular function. Such a detent ball mechanism may be seated with a biased ball partially received within a recess formed in the valve plate 420 accommodating space within which the rotary flange on the sight glass container 300 is seated. One or more corresponding detent recesses may then be formed in the opposing surface of the rotary flange member of the sight glass container 300. In certain other exemplary embodiments, other methods for the transfer of the liquid material from the source container to the sight glass container may be employed; such as rotating the sight glass container to the FILL position and simply squeezing the source container to force fluid through the system and into the container, or providing a positive displacement style pump in the system such that the user pushes the pump repeatedly to fill the sight glass container. These alternate FILL methods can accomplish the task of filling the sight glass container without the use of the pressurized fluid flow.

The method of treating a surface area with a concentrated liquid material comprises the steps of 1) establishing the correct volume of liquid material to apply to a given area by reading the instructions given on the source container for the liquid material; 2) stepping off or otherwise measuring the areas to be treated and placing markers (stones, empty cans, a stake, or other suitable marker) to identify the known areas to be treated (say in 100 square foot zones); 3) connecting the sprayer apparatus 1000 to a garden hose or other suitable source of pressurized fluid; 4) selecting FILL on the selection indicator and rotating the sight glass container to the FILL position; 5) actuating the flow control valve 80 and watching the sight glass container to see the liquid material fill the sight glass container; 6) once the determined amount of liquid material is in the sight glass container actuating the flow control valve to stop the flow of fluid and stop the filling of the sight glass container; 7) rotating the sight glass container to the DISPENSE position; 8) actuating the flow control valve to initiate the flow of fluid to dilute and dispense the liquid material in the sight glass container, pointing the sprayer into the area to be treated and spraying the area with a repetitive sweeping motion to evenly distribute the spray over the area—watching the sigh glass and spraying until all of the liquid material in the sight glass container is consumed; 9) rotating the sight glass container to the FILL position and refilling for the next area to be treated; 10) and so on until all of the areas to be treated have been sprayed; 11) when finished for this treatment session, rotating the sight glass container to the CLEAN position and actuating the flow control to initiate the flow of fluid through the device, to fill and rinse the sight glass container prior to storage; 12) in addition, should the user determine that they wish to flow just the fluid from the pressurized source and not add any liquid material, they would rotate the sight glass container to the RINSE position, actuate the flow control valve and spray non-liquid material containing fluid onto whatever surfaces desired.

Although this invention has been described in connection with specific forms and embodiments thereof, it will be appreciated that various modifications other than those discussed above may be resorted to without departing from the spirit or scope of the invention. For example, equivalent elements may be substituted for those specifically shown and described, certain features may be used independently of other features, and in certain cases, particular combinations of method steps may be reversed or interposed, all without departing from the spirit or scope of the invention as defined in the appended claims.

What is claimed is:

1. A system for accurate dosing and dispensing of a predetermined liquid material, comprising:

a housing for receiving a pressurized fluid stream, the housing having an inlet, an outlet, and an intermediate portion extending therebetween and defining an admission port for admitting the predetermined liquid material;

a measuring container operably coupled to the housing for segregating from a source a preselected portion of the liquid material to be dispensed, the measuring container including a containment vessel having at least a partially transparent sight glass portion;

a selectively operable valve assembly disposed in a flow path defined through the housing, the valve assembly including: a flow control valve selectively operable to alternatively permit or stop a flow of the pressurized fluid through the housing, and a function selection valve operable to selectively set one of a plurality of functional configurations for guiding the liquid material; and, a holding container operably coupled to the function selection valve, for storage of the predetermined liquid material, the holding container being selectively disposed in open communication with the measuring container and the flow of pressurized fluid responsive to the function selection valve;

wherein the measuring container in a first of the functional configurations is disposed in open communication with the flow of pressurized fluid through the housing, and in a second of the functional configurations is isolated therefrom.

2. The system as recited in claim 1, wherein the function selection valve defines a vacuum inducing passage, the flow of pressurized fluid being established therethrough.

3. The system as recited in claim 2, wherein the function selection valve includes:

a fluid housing having the vacuum inducing passage formed therethrough; and, a valve plate displaceably coupled to the fluid housing, the valve plate being formed with a plurality of through openings selectively disposed for open communication with the vacuum inducing passage responsive to valve plate displacement relative to the fluid housing.

4. The system as recited in claim 3, wherein the vacuum inducing passage is formed by a Venturi tube portion, the Venturi tube portion including first and second outer sections respectively converging to an intermediate Venturi throat section.

5. The system as recited in claim 4, wherein the fluid housing includes a transverse cylindrical portion coaxially receiving the Venturi tube portion, a plurality of partitions extending radially between an outer surface of the Venturi tube portion and an inner surface of the transverse cylindrical portion to define a plurality of annular chambers therebetween, the annular chambers being selectively disposed in open communication with the vacuum inducing passage responsive to displacement of the valve plate relative to the fluid housing.

6. The system as recited in claim 5, wherein the Venturi tube portion includes a through port formed in the outer surface at the Venturi throat.

7. The system as recited in claim 1, wherein the functional configurations selectable by the function selection valve include: clean, rinse, fill and dispense configurations, wherein:

in the clean configuration, the measuring container being in open communication with the flow of pressurized fluid for aspirated admission of a portion of the pressurized fluid therein, the holding container remaining isolated from the flow of pressurized fluid;

in the rinse configuration, both the holding container and the measuring container being isolated from the flow of pressurized fluid;

in the fill configuration, the measuring container being in open communication with both the holding container and the flow of pressurized fluid for inducing aspirated flow of the liquid material from the holding container to the measuring container; and, in the dispense configuration, the measuring container being in open communication with the flow of pressurized fluid for inducing aspirated expulsion of the liquid material therefrom into the flow of pressurized fluid, the holding container remaining isolated from the flow of pressurized fluid.

8. A method for selectively and accurately dosing and dispensing a predetermined liquid material, the method comprising the steps of:

establishing a first source for the predetermined liquid material and a second source for a pressurized fluid stream;

attaching to the first and second sources a housing for receiving the pressurized fluid stream, the housing having an admission port and flow path for selectively admitting and guiding the predetermined liquid material therethrough;

establishing a containment vessel having at least a partially transparent sight glass portion;

segregating from the first source and holding in the containment vessel a preselected portion of the liquid material to be dispensed responsive to selective control of at least one of the pressurized fluid stream passage through the housing and selective configuration of a function selection valve assembly disposed in the flow path of the housing for selecting at least one of a plurality of operational configurations, wherein the containment vessel in a first of the operational configurations is disposed in open communication with the flow of pressurized fluid through the housing, and in a second of the operational configurations is isolated therefrom;

storing the predetermined liquid material in a holding container operably coupled to the function selection valve assembly, the function selection valve assembly being selectively adjusted to selectively set the holding container in open communication with the containment vessel and the flow of pressurized fluid; and, mixing the segregated portion of liquid material with the fluid stream to form a mixture for release onto a predetermined area of a surface to be treated.

9. The method as recited in claim 8, wherein the flow of pressurized fluid is established through a vacuum inducing passage defined by the function selection valve assembly.

10. The method as recited in claim 9, wherein the function selection valve assembly is established to include:

a fluid housing having the vacuum inducing passage formed therethrough; and, a valve plate displaceably coupled to the fluid housing, the valve plate being formed with a plurality of through openings;

whereby the valve plate is selectively displaced relative to the fluid housing for positioning selected ones of the through openings for open communication with the vacuum inducing passage, a vacuum induced flow being thereby generated through the selected ones of the through openings.

11. The method as recited in claim 10, wherein the flow of pressurized fluid through the vacuum inducing passage generates a sub-atmospheric pressure condition by a Venturi tube effect, the sub-atmospheric pressure condition being generated at a Venturi throat section defined intermediately between converging outer sections.

12. The method as recited in claim 11, wherein the vacuum inducing passage is formed by coaxial insert of a Venturi tube portion within a transverse cylindrical portion defined by the fluid housing, a plurality of annular chambers being defined between an outer surface of the Venturi tube portion and an inner surface of the transverse cylindrical portion by establishing partitions to extend radially therebetween, the annular chambers being selectively disposed in open communication with the vacuum inducing passage responsive to displacement of the valve plate relative to the fluid housing.

13. The method as recited in claim 12, wherein a through port is established in the outer surface of the Venturi tube portion for access to the Venturi throat section.

14. The method as recited in claim 13, wherein the operational configurations selectable by corresponding adjustment of the function selection valve assembly include: clean, rinse, fill and dispense configurations, wherein:

in the clean configuration, the containment vessel is disposed in open communication with the flow of pressurized fluid for aspirated admission of a portion of the pressurized fluid therein, the holding container remaining isolated from the flow of pressurized fluid;

in the rinse configuration, both the holding container and the containment vessel are isolated from the flow of pressurized fluid;

in the fill configuration, the containment vessel is disposed in open communication with both the holding container and the flow of pressurized fluid, whereby aspirated flow of the liquid material from the holding container to the containment vessel is induced; and in the dispense configuration, the containment vessel is disposed in open communication with the flow of pressurized fluid, whereby aspirated expulsion of the liquid material from the containment vessel into the flow of pressurized fluid is induced, the holding container remaining isolated from the flow of pressurized fluid.

15. The method as recited in claim 8, wherein the sight glass portion of the containment vessel includes indicia for visually correlating the segregated portion of the liquid material to the predetermined area of the surface to be treated therewith, whereby sufficient treatment of the predetermined area with proper dosage of the liquid material may be visually confirmed by the user.

16. A system for accurate dosing and dispensing of a predetermined liquid material, comprising:

a housing for receiving a pressurized fluid stream, the housing having an inlet, an outlet, and an intermediate portion extending therebetween and defining an admission port for admitting the predetermined liquid material;

a measuring container operably coupled to the housing for segregating from a source a preselected portion of the liquid material to be dispensed, the measuring container including a containment vessel having at least a partially transparent sight glass portion; and, a selectively operable valve assembly disposed in a flow path defined through the housing, the valve assembly including: a flow control valve selectively operable to alternatively permit or stop a flow of the pressurized fluid through the housing, and a function selection valve operable to selectively set one of a plurality of functional configurations for guiding the liquid material;

wherein the measuring container in a first of the functional configurations is disposed in open communication with the flow of pressurized fluid through the housing, and in a second of the functional configurations is isolated therefrom;

wherein the flow control valve comprises a rotatable drum element displaceably coupled to the housing, the rotatable drum element including a peripheral surface defining against an inner wall surface of the housing a path for the pressurized fluid to the housing inlet, the peripheral surface having a plurality of grooves each formed with a predetermined cross-sectional area, whereby a flow rate for the pressurized fluid is selectively set.

17. The system as recited in claim 16, wherein the rotatable drum element includes a resilient face seal member offset from the grooves, the face seal member sealing the inlet when aligned therewith.

18. The system as recited in claim 17, wherein the grooves are disposed within a pair of laterally offset o-ring seals captured between the rotatable drum element and the inner wall surface of the housing.

* * * * *